United States Patent [19]

Kibby

[11] 4,388,107

[45] Jun. 14, 1983

[54] MINIMUM-ENERGY PROCESS FOR CARBOTHERMIC REDUCTION OF ALUMINA

[75] Inventor: Robert M. Kibby, Richmond, Va.

[73] Assignee: Reynolds Metals Company, Richmond, Va.

[21] Appl. No.: 205,451

[22] Filed: Nov. 10, 1980

Related U.S. Application Data

[63] Continuation-in-part of Ser. No. 140,842, Apr. 16, 1980, Pat. No. 4,334,917, and a continuation-in-part of Ser. No. 161,292, Jun. 20, 1980, which is a continuation-in-part of Ser. No. 7,986, Jan. 31, 1979, Pat. No. 4,216,010, which is a continuation-in-part of Ser. No. 881,786, Feb. 27, 1978, abandoned, which is a continuation-in-part of Ser. No. 785,676, Feb. 7, 1977, abandoned.

[51] Int. Cl.[3] ..... C22B 21/02

[52] U.S. Cl. ..... 75/10 R; 75/68 A

[58] Field of Search ..... 75/10 R, 68 A

[56] References Cited

U.S. PATENT DOCUMENTS 4,261,736 4/1981 Dewing et al. ..... 75/10 R

*Primary Examiner*—M. J. Andrews

*Attorney, Agent, or Firm*—Arthur L. Girard

[57] ABSTRACT

Alumina is carbothermically and cyclically reacted with carbon and recycled materials within a reduction zone to produce a slag layer, an overlying aluminum metal layer, and vaporization products which are passed through a vapor-permeable back-reaction zone, which comprises a feed charge mixture which is selectively connected to the reduction zone. The aluminum metal layer is initially contaminated with 20–37% of $Al_4C_3$ by weight. The vaporization products preheat and react with the feed charge mixture within the back-reaction zone to produce pre-reduction products which are selectively co-fed to the reduction zone with any unreacted portions of the feed charge mixture. The liquid/solids ratio in the back-reaction zone is limited, thereby maintaining the zone in vapor-permeable and non-slumping condition, by varying proportions of alumina fed to the back-reaction zone and to the reduction zone. The aluminum in the aluminum metal layer is selectively purified by feeding no additional carbon and by raising the reaction temperature until substantially all aluminum carbide is decomposed.

40 Claims, 5 Drawing Figures

$CO_2$ + AIR
46
42
41
44
48
CHARGE PREPARATION
DROSS
COKE
PITCH
CHARGE
49
52
$Al_2O_3$
33
30
50
GAS FLUXING
51
Al
10
16'
16
19
17
18
18
28
12
19
SLAG
21
31
35
24
25
24
15
Al+
$Al_4C_3$
22
Al
SLAG
32
34
14
23
13
37
36
38
36
37

$CO_2$ + AIR
46
42
41
44
48
CHARGE PREPARATION
COKE
PITCH
CHARGE
28
18
18
10
16'
16
19
17
12
19
21
DROSS
$Al_2O_3$
52
40
15
24
25
24
Al+
$Al_4C_3$
22
DECARBONIZATION
Al
51
14
23
13

MINIMUM-ENERGY PROCESS FOR CARBOTHERMIC REDUCTION OF ALUMINA

CROSS REFERENCES TO RELATED APPLICATIONS

This application is a continuation-in-part of U.S. patent application Ser. No. 161,292, filed June 20, 1980, which is a continuation-in-part of application Ser. No. 007,986, filed Jan. 31, 1979, now U.S. Pat. No. 4,216,010, which is a continuation-in-part of application Ser. No. 881,786, filed Feb. 27, 1978, now abandoned, which in turn is a continuation-in-part of application Ser. No. 785,676, filed Feb. 7, 1977, now abandoned. It is further a continuation-in-part of U.S. patent application Ser. No. 140,842, filed Apr. 16, 1980 now U.S. Pat. No. 4,334,917.

BACKGROUND OF THE INVENTION

1. Field of the Invention

This invention relates to the carbothermic production of aluminum from aluminum oxide and a carbon-containing material. It particularly relates to apparatuses including a reduction furnace wherein alumina and the carbon are reacted by a carbothermic process to produce aluminum contaminated with a selected small amount of aluminum carbide and wherein losses of energy and of side-reaction products are minimized.

2. Description of the Prior Art

Reviewing the literature and the patent art readily indicates that there has been much activity by many people in an attempt to adequately define a thermal process which can compete advantageously with the conventional electrolytic methods of preparing aluminum. The art has long been aware of the many theoretical advantages which can flow from the use of a thermal reduction method for the production of aluminum as opposed to an electrolytic method. These advantages are becoming increasingly important as energy costs continue to increase. Unfortunately, the vast majority of such carbothermic processes have not resulted in a significant production of aluminum in a substantially pure state.

Specifically, these efforts have failed because they have invariably produced a mixture of aluminum metal and aluminum carbide. When such a mixture of 10–20% carbide or more cools to about 1400° C., the aluminum carbide forms a cellular structure that entraps liquid aluminum; thus the mixture becomes difficult to pour. In consequence, unless extremely high temperatures are maintained throughout all of the steps, process manipulation of the mixture, in order to purify it, become extremely difficult, if not impossible.

The difficulty in producing aluminum with respect to thermal processes does not reside in the formation of the aluminum via reduction of the alumina-bearing ores, but rather, in the recovery of aluminum in a substantially pure state. The patent art, as well as the literature, is full of theories and explanations with respect to various back reactions which can take place between aluminum and the various carbon-containing compounds in the feed.

For example, U.S. Pat. No. 3,971,653 utilizes a slag containing an alumina mole fraction ($N^*$=moles $Al_2O_3$/(moles $Al_2O_3$+moles $Al_4C_3$) of 0.85 at a temperature of 2100° C., with recycle of $Al_4C_3$-containing dross to the portion of the slag which is at reduction temperature. However, because the entire reaction to produce metal occurs at $N^*=0.85$, the vaporization load is very high and the process power consumption is high.

U.S. Pat. No. 2,974,032 and U.S. Pat. No. 2,828,961 have described results that are typical of those to be expected from carbothermic reduction of a stoichiometric charge of alumina and carbon in a conventional electrically heated smelting furnace. The metal produced from the former process contains 20–37% $Al_4C_3$; the metal produced by the latter process contains 20% $Al_4C_3$. These processes are limited because reactive carbon and/or aluminum carbide is always present in contact with the metal that is produced and because time is available for the metal to react with the carbon and then to dissolve carbide up to its solubility limit.

One solution to the general problem of obtaining substantially pure aluminum from a carbothermic process is disclosed and claimed in U.S. Pat. No. 3,607,221. Although the process of this patent does result in the production of aluminum in a substantially pure state, extremely high operating temperatures are nevertheless involved which can lead to problems with respect to materials of construction. Another method for recovering substantially pure aluminum via a carbothermic process is disclosed and claimed in U.S. Pat. No. 3,929,456. The process of this patent also results in the production of substantially pure aluminum via a carbothermic process, but it does require careful control of the way the charge is heated in order to avoid aluminum carbide contamination.

By far, the most common technique disclosed in the prior art in attempting to produce aluminum of a high degree of purity has been directed to various methods of treating the furnace product which has conventionally contained about 20–35 weight percent of aluminum carbide. Thus, there are conventional techniques disclosed in the prior art, such as fluxing a furnace product with metal salts so as to diminish the amount of aluminum carbide contamination.

Unfortunately, the molten salts mix with the carbide so removed and it is costly to remove the carbide from the salts so that the carbide can be recycled to the furnace. Without such recycle, the power consumption and furnace size become uneconomical in comparison with prior methods practiced commercially for making aluminum.

U.S. Pat. No. 3,975,187 is directed towards a process for the treatment of carbothermically produced aluminum in order to reduce the aluminum carbide content thereof by treatment of the furnace product with a gas so as to prevent the formation of an aluminum-aluminum carbide matrix, whereby the aluminum carbide becomes readily separable from the alumina. Although this process is very effective in preserving the energy already invested in making the aluminum carbide, it requires a recycle operation with attendant energy losses associated with material handling.

In U.S. Pat. No. 4,099,959, a molten alumina slag is circulated through ducts, while being resistance heated in inverse relationship to the cross-sectional areas of the ducts, into alternating low and high temperature zones. The low-temperature zone is at a temperature high enough to produce aluminum carbide, and the high-temperature zone is at a temperature high enough to react aluminum carbide with alumina and produce aluminum. Off gases are first scrubbed through a first charge column containing only carbon and then through a second charge column containing only alumina in oder to preheat these charge materials without forming a "sticky" charge because of partial melting of aluminum oxycarbide. The low and high temperature zones operate entirely within the molten range for a slag composition within N* values of 0.82–0.85.

U.S. Pat. Nos. 3,929,456 and 4,033,757 disclose methods for carbothermically producing aluminum containing less than 20% $Al_4C_3$, i.e., 5–10%, which comprise striking an open arc intermittently to a portion of the surface of the charge to be reduced.

However, advances have now been made in the art, wherein aluminum that is contaminated with about 20% aluminum carbide can be treated so as to obtain aluminum of commercial purity. One such technique is described in U.S. Pat. No. 4,216,010. This technique is adaptable to the production of aluminum containing less than 20% $Al_4C_3$ (i.e., 10%). It comprises the step of contacting a product containing from 20–35% $Al_4C_3$ with a melt rich in alumina in the absence of reactive carbon. Such purification techniques can impart commercial vitality to older carbothermic processes producing heavily contaminated aluminum. Thus it becomes worthwhile to locate the best existing prior art and to improve the effectiveness thereof.

In view of rapidly rising energy costs and regardless of the method that is employed to produce aluminum containing less than 20% $Al_4C_3$, it is clear that measures must be taken to limit the energy lost to vaporized products, as one such improvement. Energy lost to vaporization depends on the amount of vapor produced in the reduction and decarbonization steps and also depends on the amount of vapor that is recovered in back reactions which release heat at times and places within the system where that heat released can be employed in pre-reduction reactions. There is also a need to minimize the quantities of product aluminum and of by-products which escape from the hearth in order to minimize energy losses associated with these materials; to return vaporized materials to the reduction zone before undesirable reactions occur (such as $Al_2O$ with oxygen in air), and maximize the proportion of $Al_4C_3$ that is formed outside of the reduction zone.

The process U.S. Pat. No. 4,216,010 is effective with any amount of aluminum carbide contamination greater than about 2 weight percent. However, as indicated earlier, unless special procedures are used, e.g., U.S. Pat. Nos. 3,607,221 and 3,929,456, the amount of aluminum carbide contaminant which is produced by a so-called conventional reduction furnace ranges from about 20 to about 35 weight percent.

The process of U.S. Pat. No. 4,216,010 is directed particularly towards treatment of aluminum which is contaminated with from about 20 to about 35 weight percent of aluminum carbide, which is that amount of carbide contamination which is produced by a so-called conventional carbothermic reduction furnace, but it may also be used to treat aluminum which is contaminated with from about 2 to about 10 weight percent aluminum carbide as would be produced in furnaces used primarily for the production of aluminum such as those described in U.S. Pat. Nos. 3,607,221 and 3,929,456.

The novel process of U.S. Pat. No. 4,216,010 is carried out simply by heating the furnace product contaminated with aluminum carbide with a molten slag containing substantial proportions of alumina so as to cause the alumina in the slag to react with the aluminum carbide in the furnace product, thereby diminishing the furnace product in aluminum carbide. The expression "alumina in the slag to react with the aluminum carbide" is intended to describe various modes of reaction. While not wishing to be limited to a particular theory of operation, nevertheless, it appears that at least 2 modes of reaction as between the alumina in the slag and the aluminum carbide in the furnace product are possible.

One such mode can be described as the "reduction mode" and it involves reaction between the alumina in the slag and the aluminum carbide in the furnace product at reduction conditions so as to produce aluminum metal. One way of ascertaining operation in this mode is by the evolution of carbon monoxide.

Another such mode of reaction can be described as the "extraction mode" and it involves reaction between the alumina in the slag and the aluminum carbide in the furnace product so as to produce non-metallic slag compounds such as aluminum tetraoxycarbide, as opposed to producing liquid aluminum. Such "extraction mode" reactions occur at temperatures insufficient to cause reduction to produce additional aluminum and can occur without causing the evolution of carbon monoxide.

It is to be understood that said "extraction mode" can take place along with the "reduction mode".

In general, temperatures of at least 2050° C. are necessary for the "reduction mode" operations at reaction zone pressures of one atmosphere. At any given pressure, the temperature required for "reduction mode" operation increases, as the level of aluminum carbide in the metal decreases. On the other hand, "extraction mode" operations can take place below 2050° C.

Although a furnace with a roof forming a hearth shoulder to support the charge column thereabove provides satisfactory apparatus means for the control of charge to the hearth of the furnace, a method for controlling the amount of charge that is admitted to the hearth is generally more desirable. Such a method, moreoever, has the advantage that it can be useful in many furnaces of differing configurations, to control the amount of charge that is admitted to the hearth.

SUMMARY OF THE INVENTION

An object of this invention is accordingly to provide a method and apparatuses for producing the aluminum by carbothermic reduction of alumina while limiting the energy lost to vaporization to the equivalent of vaporizing from 10 to 20% of the aluminum in the feed.

An additional object is to provide a capture method for passing gases from the hearth countercurrently to the incoming charge materials, whereby much of the sensible heat, the heats of reaction, and the vaporized materials become part of the incoming charge.

A further object is to conduct this capture method without losing permeability to gases within the incoming charge materials.

In certain embodiments, a still further object is to be able to support a column of the incoming charge materials without utilizing a hearth shoulder as the upper surface of the roof for the hearth.

The method employed to limit vaporization losses provides for the maintenance of one or more zones of reactants and pre-reduction compounds in which gaseous products back react to produce alumina and aluminum carbide. The method includes a procedure to limit the liquid/solid ratio (L/S) in such back reaction zones so that an accessible environment for the necessary back reactions can be maintained. At one extreme, this technique includes charging feed carbon only to the top of the charge column and all of the alumina for reduction to the hearth of the furnace.

The method for limiting such vaporization losses also includes limiting the production of vaporized materials during the reaction for producing liquid aluminum. This vapor limiting method operates by performing as much of the reduction as possible while solid aluminum carbide is present in the reduction zone in contact with the slag and then finishing the reduction by decomposing a slag containing aluminum carbide and alumina in solution until the furnace product is decarbonized to contain the desired amount of carbides (i.e., 10%).

In the preferred embodiment, this last step uses the reduction decarbonization method as defined in U.S. Pat. No. 4,216,010, the entire disclosure of which is incorporated herein by reference, because the process to decompose the slag moves the composition of the slag toward alumina richness, as required for equilibrium with metal containing less than 25% $Al_4C_3$.

The carbothermic process of this invention for producing aluminum containing selected minor amounts of aluminum carbide comprises the following steps:

A. reacting a mixture comprising solid aluminum carbide and carbon with a liquid slag comprising alumina and aluminum carbide while providing a heat input sufficiently high to produce liquid aluminum containing aluminum carbide;

B. decomposing this slag in the absence of reactive carbon and of solid aluminum carbide to provide additional aluminum and carbon monoxide;

C. passing gases produced in steps A and B through at least one zone where these gases react to produce alumina, aluminum, tetraoxycarbide, and aluminum carbide;

D. combining the products of step C as part of the charge mixture in step A for reacting with liquid slag; and E. recovering product aluminum containing aluminum carbide from step B which contains the desired minimum amount of aluminum carbide.

Such product aluminum recovered in step E contains from 4–12% $Al_4C_3$. Part of the alumina feed which is stoichiometrically required for production of alumina is added in step A and part is added in step C in order to control the L/S ratio and the permeability of the charge column containing charge materials and through which the gases pass countercurrently. After passage through the charge materials, these gases escape from the apparatus as residual gases containing a fume. Although the charge materials are preferably added in a vapor-permeable charge column, they may be added in one or more fluidized bed reactors wherein heat transfer, reaction of by-products, and separation of residual gases can be conducted.

This carbothermic process particularly also selectively includes steps for: (a) controlling the admission of reactants to step A in order that the slag of steps A and B can be depleted of reactive carbon, (b) following the alumina/aluminum carbide-decreasing steps of U.S. Pat. No. 4,216,010, and (c) conducting the purification steps of Ser. No. 161,292.

More specifically, the method of this invention produces aluminum as a final aluminum furnace product containing not more than 15% $Al_4C_3$ by carbothermic reduction of $Al_2O_3$ while limiting energy losses to gas production to the equivalent of vaporizing not more than 20% of the aluminum contained in all furnace feed materials. This method comprises:

A. producing aluminum as an initial aluminum furnace product, which is contaminated with 20–37% $Al_4C_3$ by weight, by reacting alumina, carbon, and recycled materials, according to the following steps:

(1) providing a reduction zone containing electrodes, a reduction charge admission means disposed above the reduction zone, and a charging port furnishing access to the reduction zone while bypassing the admission means, (2) forming a molten slag layer containing 80–97% $Al_2O_3$ by weight within the reduction zone, (3) preparing a feed charge mixture comprising the carbon, recycled materials, and a part of the alumina that is stoichiometrically needed for making the initial aluminum furnace product, (4) providing at least one vapor-permeable back-reaction zone which is connected to the reduction zone by the charge admission means, (5) transferring through the charge admission means, from the back reaction zone to the reduction zone, an amount of the feed charge mixture that contains an amount of carbon which is approximately stoichiometrically equivalent to the final aluminum furnace product, (6) adding directly to the reduction zone through the charging port a quantity of alumina which, in combination with a part of the alumina admitted to the slag layer through the charge admission means, comprises an amount of alumina which is approximately stoichiometrically equivalent to the aluminum to be contained in the final aluminum furnace product, and (7) generating sufficient heat, by passage of electric current between electrodes, to cause the hearth charge mixture to react with the slag layer and produce the initial aluminum furnace product as a separate liquid layer over the slag layer, while producing vaporization products which react in the back reaction zone to cause a production of pre-reduction products;

B. limiting the liquid/solids ratio in the back reaction zone and thereby maintaining the back reaction zone in non-slumping and vapor-permeable condition by varying proportions of feed alumina that are selectively fed to the back reaction zone and directly to the reduction zone;

C. finishing the reduction for producing the final furnace product according to the following stages:

(1) operating the charge admission means whereby no additional carbon is fed as the charge mixture to the reduction zone, while reduction proceeds and (2) heating the slag layer until the reaction temperature rises in the reduction zone and the slag is decomposed to form the final aluminum furnace product as a separate liquid layer; and D. removing the final aluminum furnace product to complete a production cycle.

This final product is treated in a finishing furnace to produce pure aluminum product and a dross which is skimmed therefrom. Alternatively, the final product can be treated according to the disclosures of U.S. Pat. No. 4,216,010, and application Ser. No. 161,292, filed June 20, 1980, the entire disclosure of which is herein incorporated by reference, to produce a pure aluminum product and the vapors which are then fed to the back reaction zone.

The cycling method further comprises repeating steps 5 through 7 of paragraph A and all the steps of paragraph B–D as additional production cycles.

The vaporization products comprise Al, $Al_2O$, and CO. The recycled materials comprise furnace fume which is collected from the CO and some or all of the dross which is collected from the final finishing furnace. The fume and dross are preferably mixed with the carbon and a portion of the alumina fed through the back reaction zone and are formed into briquettes which are coated with carbon to minimize fusion within the zone.

Production of aluminum begins with a composite alumina mole fraction in the slag layer of 0.4–0.6, and it continues while the solid $Al_4C_3$ is in contact with the slag having an alumina mole fraction up to about 0.775. The purification for the method continues by maintaining the electrodes above the liquid aluminum layer to provide heating and to react the aluminum carbide in the aluminum layer with the alumina in the slag layer until the alumina mole fraction of the slag layer is approximately 0.91 to 0.93 and the aluminum layer contains about 9.5% to 4% aluminum carbide and 12% alumina.

The liquid/solids ratio in the charge column is in the range of 27/73 to 52/48 when the temperature in the back reaction zone is below 2000° C. and more preferably about 1970° C.

The back reaction zone may be a single charge column which surrounds the electrodes and is exposed directly above the hearth containing the reaction zone. However, a pair of charge columns which are outside the furnace and are connected to a pair of charging ports to the hearth is very satisfactory, particularly when the charge mixture is added to the first charge column and the alumina, mixed with carbon in a weight ratio of 80:20 to 90:10 is added to the second charge column.

It is also desirable to operate the back reaction zones as fluidized beds within the pair of charge columns by adding the pre-reaction compounds in powder form thereto. Both the first and second charge columns discharge independently to the hearth, but the vaporization products enter the first charge column and then enter the second charge column as fluidizing gases therefor. For example, when about 30% of the feed alumina and all of the carbon are added to the fluidizing bed in the first charge column and are converted to $Al_4C_3$ therein and when the remaining feed alumina is preheated in a fluidizing bed within the second charge column and then added to the furnace, the liquid/solid ratio in the first charge column is about 45/55.

The characteristics of this invention can be illustrated by comparisons with U.S. Pat. No. 4,099,959. The process of this patent is a continuous operation with the events and the changes in composition occurring at different locations within the system, all producing metal over a narrow slag composition range of $N^*=0.83–0.85$. It produces all of its $Al_4C_3$ for reduction in the slag and produces all the metal by reaction of $Al_4C_3$ in the slag solution with $Al_2O_3$ in solution in the slag. It keeps carbon in contact with the liquid metal product at temperatures where aluminum in equilibrium with carbon would yield a product having aluminum carbide in excess of 20% and passes vapors from metal production through a charge pre-heating column to which only carbon has been charged. Finally, the process of U.S. Pat. No. 4,099,959 moves molten slag from one vessel to another.

In contrast, the process of this invention is preferably a batch process in its reduction and decarbonization stages with the events and changes in composition occurring at different times at the same location within the system. It produces metal with the reactant composite on the hearth having a wide range of $N^*$, starting at 0.4 and ending at 0.94. It produces a large part of its $Al_4C_3$ for reduction in a charge column. In fact, with less than about 67% of the alumina for reduction being added directly to the hearth, all of the $Al_4C_3$ for reduction may be produced in the charge column.

Moreover, this invention produces as much metal as possible by reacting solid $Al_4C_3$ with the $Al_2O_3$ in solution in the slag. This reaction occurs during the portion of the metal production stage where $N^*$ of the composite on the hearth is between about 0.775 and 0.4.

In addition, this invention removes reactive carbon from the metal product during the final stages of metal production and produces metal having as low as 2% $Al_4C_3$ contamination. It passes gases from metal production to a charge preheating and prereduction column where all of the carbon and some, but not all, of the alumina for reduction are charged. In a preferred embodiment, about $\frac{1}{4}$ of the alumina for reduction is added with the carbon through the charge column and about $\frac{3}{4}$ is added directly to the hearth. Finally, this invention preferably keeps molten slag in one location, the hearth of the primary furnace.

The method of this invention may also be illustrated with respect to the five apparatus embodiments (three single-column embodiments, one twin-column embodiment, and one fluidized-column embodiment), as follows:

(1) charge materials include fume, dross, carbon, and alumina;

(2) all fume, some or all of the dross, part of the alumina, and all or a part of the carbon are intimately mixed in the form of briquettes (except for the fluidized-column embodiment);

(3) the remaining portion of the alumina and the remaining portions of the dross are fed to the hearth which contains a molten slag layer within a reduction zone;

(4) selective feeding of the alumina portions are balanced to maintain the charge column in gas-permeable condition while forming as much $Al_4C_3$ as possible within the column;

(5) the charge column is disposed directly above the hearth for the three single-column embodiments;

(6) the two columns of the twin-column and fluidized-column embodiments may be disposed alongside and above the hearth;

(7) In all embodiments except the fluidized bed embodiment, the gases that are evolved from the reactions occurring within the hearth are fed to the charge column or columns and move countercurrently to the downard movements of the charge materials;

(8) while passing through the interstices of the charge materials, the gases transfer their sensible heats to the materials which become increasingly hotter as they approach the back reaction and reduction zones;

(9) numerous reactions occur among the charge materials and the components of the gases within a plurality of back reaction zones, releasing reaction heat to the charge materials;

(10) the products of these reactions include $Al_4O_4C$ and $Al_4C_3$ as intermediates for alumina production;

(11) the residual gases escaping from the back reaction zones are fed to an apparatus which separates fume from the residual gases and sends the fume to a charge preparation apparatus;

(12) in all embodiments, a sufficient quantity of carbon-containing materials to produce the desired quantity of aluminum for a production cycle is fed to the hearth at the beginning and during the early part of that cycle;

(13) when the electrodes are placed in contact with the hearth melt layer and electrical current is supplied to the electrodes, the temperature generally does not rise above about 2000° C. while there is carbon that is available to form $Al_4C_3$, and no significant quantity of aluminum metal is formed;

(14) the N* value for the materials on the hearth drops to as low as 0.4 at the time that all of the carbon has reacted and just before the temperature rises to about 2080° C.;

(15) after depletion of carbon and after the temperature has reached about 2080° C., aluminum metal is formed by reaction of solid $Al_4C_3$ with the alumina in solution in the slag, forming a molten aluminum layer that overlies the molten slag layer;

(16) such reduction continues until N*=about 0.775 in the composite on the hearth;

(17) as N* proceeds from about 0.775 toward about 0.91 to 0.93 the electrodes are kept out of contact with the melt and the temperature rises to about 2130° C. as N* approaches 0.93 producing liquid aluminum containing 4–10% $Al_4C_3$;

(18) extraction mode decarbonizing then occurs, either in the primary furnace (with alumina being fed there) or in a secondary furnace with alumina being fed there and slag being recycled countercurrently to flow of metal) until N*=about 0.96; and

(19) additional decarbonizing in a conventional furnace is then followed to produce commercially-pure aluminum.

While not wishing to be limited to any particular theory, the reactions which occur within the back reaction zones and the reduction zone are as follows, depending upon temperature conditions:

$$2Al_2O_3(S)+3C \rightleftharpoons Al_4O_4C(S)+2CO \quad (R1)$$

$$Al_4O_4C(S) \rightleftharpoons Al_4O_4C(l) \quad (R2)$$

$$Al_4O_4C(l)+6C \rightleftharpoons Al_4C_3(S)+4CO \quad (R3)$$

$$2Al_2O_3(l, Slag)+9C \rightleftharpoons Al_4C_3(S)+6CO \quad (R4)$$

$$Al_2O_3(l,Slag)+Al_4C_3(l,Slag) \rightleftharpoons 6Al(l)+3CO \quad (R5)$$

$$Al(l) \rightleftharpoons Al(g) \quad (R6)$$

$$4Al(g)+Al_2O_3(l,Slag) \rightleftharpoons 3Al_2O \quad (R7)$$

$$Al_4O_4C(S)+C \rightleftharpoons 2Al_2O+2CO \quad (R8)$$

$$Al_2O_3(l,Slag)+Al_4C_3(C) \rightleftharpoons 3Al_2O+3C \quad (R9)$$

$$3Al_2O \rightleftharpoons Al_2O_3(S)+4Al(l) \quad (R10)$$

$$4Al(g)+3C \rightleftharpoons Al_4C_3(S) \quad (R11)$$

The method of this invention can further be characterized in terms of stages occurring in specific locations and at specific terms, as follows, beginning at the top of the charge column;

Stage I—Charge pre-heating occurs. Fume scrubber dust is returned from the scrubber to charge preparation. The only chemical reaction occurring is oxidation of $Al_2O$ while it is leaving the top of the charge column to enter the fume scrubber.

Stage II—A first pre-reduction stage occurs high in the charge column in which solid alumina and carbon react to produce $Al_4O_4C$ and in which $Al_2O$ vapors react according to equation R8 and in which aluminum vapor reacts with carbon to form solid $Al_4C_3$ according to equation R11.

Stage III—A second pre-reduction stage occurs in the lower parts of the charge column in which all remaining $Al_2O_3$ or carbon (whichever is depleted last) reacts to form solid $Al_4C_3$ and in which $Al_2O$ vapor reacts according to equation R9. Aluminum vapor encountering only $Al_4C_3$ condenses to liquid aluminum and drops with the charge from the bottom of the charge column to the hearth.

Stage IV—A mixing stage occurs on the hearth where the charge from the bottom of the charge column, containing carbon and/or $Al_4C_3$ and/or $Al_4O_4C$ and/or Al, is mixed with the alumina which is added to the hearth or to slag which is recycled to the hearth from earlier operations for adjusting the composition and obtaining balanced metal production. When unreacted carbon is available, reaction R4 occurs.

Stage V—The material in the reduction zone on the hearth comprises a liquid slag having N*, generally about 0.77 to 0.78, mixed with solid $Al_4C_3$ and other products of Stage III pre-reduction. The composite compositions of such a mixture ranges from about N* 0.5 to about 0.775, starting from 0.4 and increasing to about 0.775 as reduction continues and solid aluminum carbide disappears from the composite.

Stage VI—As decarbonizing occurs at N* values greater than about 0.775 to produce aluminum with the electrodes clear of the metal on the hearth, N* becomes a final value desired according to the reduction decarbonization mode defined in U.S. Pat. No. 4,216,010. This may be the final stage in the primary furnace.

Stage VII—Extraction mode decarbonizing is achieved according to the extraction mode as defined in U.S. Pat. No. 4,216,010. The furnace for carrying out this decarbonizing, if separate from the primary furnace, is the "DECARB Furnace".

Stage VIII—Further decarbonization occurs in a conventional holding furnace operation by simple separation of the molten product of previous stages into two fractions, product metal and a dross containing some aluminum, some aluminum carbide, and some slag components. Tri-gas aids such separation into a molten aluminum product fraction and/or dross fraction.

Providing a workable means to control the percent liquid in the upper regions of the charge column, so that primary furnace vaporization losses can be controlled, is a principle objective of this invention. Obviously, one way of doing so is to return the dross of Stage VIII to the hearth of the primary furnace. This procedure will result in even lower liquid percentages at the end of Stage II, but at the expense of energy because heat released by $Al_2O$ back reactions could not then be used to heat the dross.

An important feature of this invention is the provision of means, exemplified by the shoulder formed by the upper surface of the hearth roof in two of the single-column apparatus embodiments, to control the admission of carbon-bearing charge to the hearth. As long as carbon and alumina are both present, with hearth temperatures all below 2000° C., slag will be produced within the hearth, but not a significant amount of aluminum. To remedy this situation, charge admission must be controlled so that the hearth runs out of free carbon before Stage V can begin. The hearth shoulder is provided so that this charge control can be obtained while still providing a charge column in which vapor back reactions can release heat usefully.

When the electrodes are in contact with the slag or charge materials mixed with the slag as in Stage V, temperatures are fairly uniform over the reaction zone and are not greater than required to make the reduction reactions go. There is a surplus of alumina on the hearth to provide conditions for decarbonization during Stage VI. As long as free carbon exists, reactions R1 and R3 will proceed, thereby limiting their temperature to a level at least 75° below the temperature required to produce metal.

The preemptive-heat absorption by the reactions to produce slag can be overcome if sufficient superheat is given in Stage V, as by open arc. But the vapor production rate for open-arc reduction throughout Stage V is poorer than for submerged-arc reduction.

DESCRIPTION OF THE PREFERRED EMBODIMENTS

Figure 3:
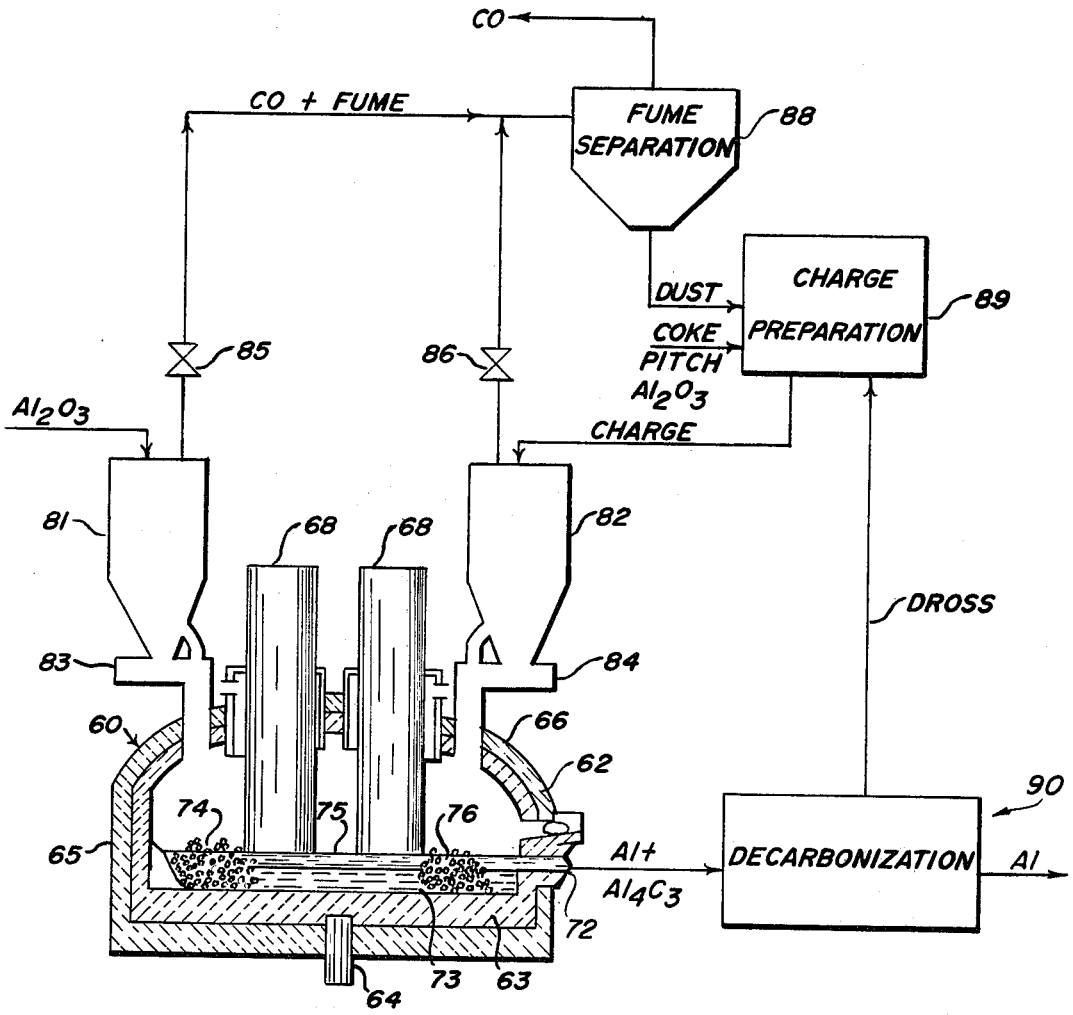
FIG. 3 is a sectional elevation of a carbothermal reduction furnace having separate charge columns for its alumina and carbon-based mixture through which separate vapor streams pass in parallel and countercurrently through the charge materials. This furnace is connected to a decarbonization furnace as a part of a schematically illustrated closed recycling system.

Five preferred apparatus embodiments are described hereinafter. The first is a three-component apparatus shown in FIG. 1, including a primary furnace having a hearth shoulder. The second is the same as the first, except that considerably more reduction mode decarbonization is conducted in the primary furnace, the extraction mode "decarb" furnace is omitted, the alumina not added with the top charge is added to the hearth of the primary furnace, and it is not required that alumina-rich liquid slag be charged to the hearth of the primary furnace. The third comprises the pair of charge columns shown in FIG. 3. The fourth, the fluidized embodiment, comprises the fluidized-bed columns of FIG. 4. The fifth, which is also a single-column embodiment, comprises the moving-bed shaft furnace shown in FIG. 5. All of the charge columns, except the fluidized-bed colunns of FIG. 3, are permeably supported to permit countercurrent flow of reaction gases from the hearth.

Five operational systems or process embodiments are preferably employed with these five apparatus embodiments, as follows: (1) countercurrently feeding a portion of the alumina in the form of slag from the decarb furnace to the primary furnace of FIG. 1; (2) feeding a portion of the alumina only into the reduction zone of the hearth in the primary furnace of FIG. 2; (3) feeding the entire charge to the twin permeably supported columns of FIG. 3; (4) feeding the entire charge to the twin fluidized columns of FIG. 4; and (5) feeding a portion of the alumina to the reduction zone for the hearth in the primary furnace of FIG. 5. The second system does not require recycling of alumina-rich slag as in the first system.

The first process embodiment comprises three operations: crude aluminum production in a primary furnace that produces crude aluminum containing about 9.5% $Al_4C_3$ and 12% $Al_2O_3$ as the initial operation and then decarbonizing the crude aluminum in: (a) a decarbonization furnace to which much of the alumina is fed and which produces aluminum containing about 2% of $Al_4C_3$ and slag as the second operation, and (b) a finishing or gas fluxing furnace that produces commercially pure aluminum and dross as the third operation. The term, "countercurrent", is appropriate for this system because the slag from the decarbonization furnace is fed to the primary furnace, thereby moving countercurrently to the flow of aluminum.

The four remaining process embodiments require only two operations because each uses the primary furnace for both crude aluminum production and for a part of the decarbonizing that is needed, thereby producing aluminum containing 4–10% $Al_4C_3$ in this first operation for the second, third, and fourth systems and about 2% $Al_4C_3$ for the fifth system. Almost any suitable decarbonizing method can be used for the second operation, except the slag producing method of the first system.

While these embodiments describe pairs of electrodes (i.e., carbon) as a means to generate heat for reduction and decarbonization, it is to be understood that plasma torches may be used, such as those disclosed in U.S. Pat. No. 3,153,133, in which case the electrode "pair" comprises the cathode emitter and the anode ring components of the plasma torch.

Figure 1:
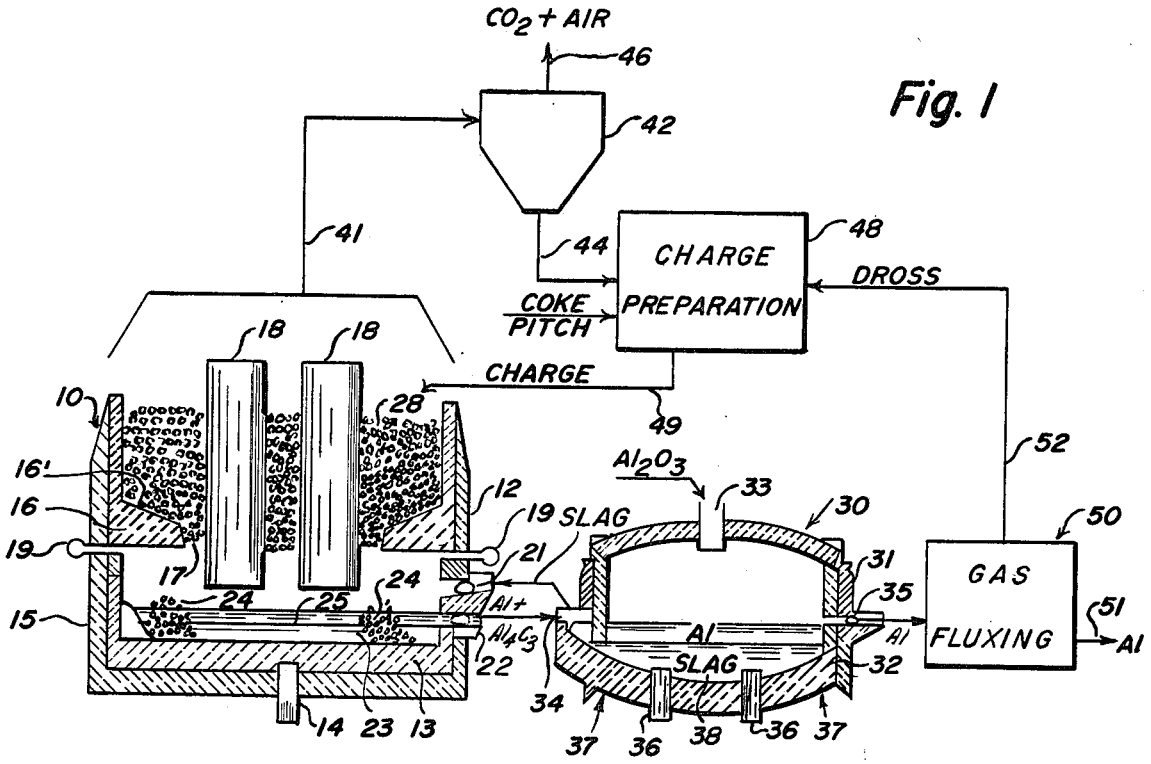
FIG. 1 is a sectional elevation of a moving bed shaft carbothermal reduction furnace having hearth shoulders as a charge admission control device and a decarbonizing furnace which are operably connected into a schematically illustrated closed recycling system.

The schematically illustrated closed recycling system shown in FIG. 1 preferably includes a primary furnace 10 which is lined with refractory brick 12 as insulation and a hearth of carbon 13 which is connected to an electrical bus through graphite stubs 14. Inside the insulation is refractory lining 15 and inner roof 16 having an upper surface forming a shoulder 16' and shaped to allow a space 17 around electrodes 18 which are connected in parallel to a second side of the electrical circuit. Plenum and port means 19 are provided to maintain an inwardly directed flow of carbon monoxide to prevent condensation of aluminum across the inner wall, thus preventing the electrical short circuiting of roof 16 to hearth 13. A tapping port 22 and a charging port 21 are also provided.

Secondary furnace 30 is provided with insulation 31, innner refractory (non-carbonaceous) lining 32, charging port 33 for granular material, charging and tapping port 34 for transferring liquids to and from the primary furnace, and port 35 for tapping the product. Electrodes 36 are provided to conduct heating power through the liquid within furnace 30. Jacking means 37 are provided to raise furnace 30 so that liquids may be transferred from port 34 to the hearth of furnace 10 through port 21. Primary furnace product is received in port 34 from furnace 10 through port 22. Furnace 30 is called the "DECARB Furnace".

A dust collector 42 is provided to separate fume and residual gases that are emitted from furnace 10 through line 41 and to return the fume to a charge preparation apparatus 48 through line 44 to be incorporated into the charge of furnace 10, while allowing the cleaned residual gases to leave the system through line 46.

A third furnace 50 is provided which is called the "Finishing Furnace". It is of conventional holding furnace design, being provided with a charging port, a tapping port, and a means to sparge fluxing gas under the top level of the furnace melt. The finished or product aluminum leaves furnace 50 through line 51, and dross passes through line 52 to charge preparation apparatus 48.

In charge preparation apparatus 48, coke, alumina, fume, dross, and pitch are mixed and prepared in the form of briquettes as charged material to be sent to furnace 10 through line 49.

EXAMPLE 1

A charge 28 is made up in the form of briquettes having two compositions A and B. In the preparation of the briquettes for charge composition A (see U.S. Pat. No. 3,723,093, column 8, lines 50–65), aluminum hydroxide powder, prepared in accordance with the Bayer method, is converted to alumina powder by heating at 600°–1000° C. This alumina powder and a petroleum coke powder, ground to pass 100 mesh screen, are mixed in a weight ratio of 85:15 for preparing charge composition A.

Briquettes of composition B are made up of petroleum coke, petroleum or coal tar pitch, furnace fume collected in the dust collector, and dross skimmed from finishing furnace 50. The briquettes may be baked to 800° C. to drive off binder fumes before being charged to the furnace.

The starting operation to bring the primary furnace up to its steady-state operating condition is carried out in the following manner. The furnace is initially heated by a flow of current from the electrodes to a bed of crushed coke as in the practice of starting a silicon furnace. When the hearth is adequately heated according to silicon furnace practice, sufficient alumina is added to form a liquid layer 23 over the hearth. The composition of liquid layer 23 is equivalent to a melt of alumina and aluminum carbide having alumina in the weight range of 80% to 97%. The preferred range is 85% to 90% $Al_2O_3$, the balance being $Al_4C_3$.

At this point, charge of composition A is added and the electrodes are pulled up to open arc condition in order to build up liquid layer 23 to a depth of approximately 12 inches. As charge is further added and is smelted to produce liquid for layer 23, additional alumina is added to maintain the weight ratio in liquid layer 23, in parts by weight ranging from 80 $Al_2O_3$/20 $Al_4C_3$ to 97 $Al_2O_3$/3 $Al_4C_3$. Only enough briquettes of composition A are added to provide the desired depth of layer 23 which is the "slag" layer. If the slag layer should become too lean in its content of $Al_4C_3$, a correction can be made by adding coke and continuing the heating under the open arc. When the molten slag layer of desired composition has been established, charge B is added to surround the electrodes above the roof 16, thus providing a charge column 28 in which vapor products can react and release heat. An amount of charge from charge column 28, stoichiometrically equivalent to the metal to be tapped, is stoked to fall upon slag layer 23, forming reactant charge 24 upon and within the hearth. The electrodes are then lowered enough to make electrical contact with the liquid layer, and sufficient heat is generated by passage of electric current through liquid 23 to cause charge 24 to react with liquid slag layer 23. (In subsequent cycles, slag from furnace 30 is added at this time to charge 24.)

As reduction proceeds (stage V), aluminum containing from 30% to 35% $Al_4C_3$ is formed and rests as a separate liquid metal layer 25 over slag layer 23. At the same time, some aluminum vapor and aluminum monoxide ($Al_2O$) gas are produced. These mix with CO formed by the aluminum producing reaction and pass upwardly through charge column 28 where exothermic back reactions occur, releasing heat and producing compounds which recycle down with the charge to produce aluminum carbide as temperatures become higher. The gases or vapors continue to rise through the charge column, becoming cooler and reacting further until the top of charge column 28 is reached and the residual gases pass through line 41 to apparatus 42 wherein fume is removed and the cleaned residual gases leave by line 46. The heat released within column 28 by these vapor back reactions is used to preheat charge and to provide heat to cause charge B to produce $Al_4O_4C$. At higher temperatures closer to the bottom of charge column 28 and to roof 16, the charge with composition B reacts with recycled vaporization products to produce $Al_4C_3$.

Stage V proceeds with the electrodes in contact with the charge or melt until substantially all reactive carbon in charge 24 is depleted and the composite (slag+-charge) composition on the hearth has a molecular ratio N* equal to about 0.775, as moles $Al_2O_3$ divided by (moles $Al_2O_3$ plus moles $Al_4C_3$).

To convert this metal product of Stage V, containing from 30 to 35% $Al_4C_3$, to a product containing about 10% $Al_4C_3$, decarbonizing according to Stage VI is employed by pulling the electrodes just clear of layer 25, thereby causing open arc heating to begin. Such open arc heating requires a higher voltage between the electrodes than when the electrodes are in contact with the melt, but only enough voltage is applied to operate at such reduced current that the total power input is the same as or less than during Stage V when the electrodes were in contact with the liquid layer.

This open arc heating during Stage VI is continued until the slag layer has a composition N*=0.91 while employing the reduction decarbonization mode defined in U.S. Pat. No. 4,216,010. At this point, the metal contains about 9.5% $Al_4C_3$ and 12% $Al_2O_3$ in solution. The liquid slag has a general temperature of about 2100° C., although the temperature where the arc strikes the liquid may be as high as 2400° C. Either temperature is high enough to allow the metal to rest as an immiscible layer upon the slag layer.

The metal is then decanted to decarb furnace 30 to complete Stage VI. More $Al_4C_3$ charge from the pre-reduction zone is stoked to fall onto the slag layer of furnace 10, more recycle slag is added to the slag layer, the electrodes are brought into contact with the hearth liquid, and Stage V is cyclically repeated.

The heat intensity reaching the charge from the arc must be limited, otherwise the vaporization will be so great that pre-heat and pre-reduction reactions in charge column 28 cannot absorb the back reaction heat. Under these conditions, the furnace is thermally unstable, and unreacted vapor products will blow out of the top of the charge column, releasing excessive heat and wasting valuable reactants.

In furnace 30, the metal containing about 9.5% $Al_4C_3$ and 12% $Al_2O_3$ from Stage VI in the primary furnace is floated as metal layer 39 upon a slag layer 38 having $N^*=0.96$. This slag layer 38 also has about 15% CaO and is a liquid which is immiscible with and has greater density than the $Al_4C_3$-Al metal layer when operating at about 1650° C. Most of the alumina stoichiometrically required for the aluminum product is added to decarb furnace 30 to form an insulating cover and eventually go into the slag solution (layer 38) to maintain $N^*=0.96$ after the $Al_4C_3$ has been extracted from the metal according to the extraction mode of U.S. Pat. No. 4,216,010, according to Stage VII.

When the metal is suitably fluid in layer 39 and has an $Al_4C_3$ level of about 2%, it is decanted from slag layer 38 of decarb furnace 30 and sent to finishing furnace 50 by tilting decarb furnace 30 with jacks 37. The slag generated in the extraction operation of Stage VII within furnace 19 is recycled to the hearth of primary furnace 10 to be used in Stage IV for adding to and mixing with charge 24 which has dropped from column 28.

Purification according to Stage VIII is accomplished by sparging Tri-Gas or some other conventionally used aluminum fluxing gas into the melt until all of the alumina and aluminum carbide present in the metal product from Stage VII has come to the surface of the aluminum as a dross. This operation occurs at about 900° C. The dross is skimmed and incorporated into primary furnace charge briquettes in apparatus 48 after passing through line 52 without significant delay, so that the aluminum carbide does not have an opportunity to hydrolyze. Finished aluminum product of commercial purity is then tapped from finishing furnace 50 to complete Stage VIII of the process.

The mass and energy balance for the Example just described shows that the equivalent mole fraction of the reaction stage composites progresses from $N^*=0.51$ at the end of Stage II, to 0 (100% $Al_4C_3$) at the end of Stage III, to 0.468 at the end of stage IV, to 0.775 at the end of Stage V, to 0.910 at the end of Stage VI, and to 0.96 at the end of Stage VII.

Correspondingly, the percent liquid in the charge column is 35% at the end of Stage II, 0% at the end of Stage III, and 46% at the end of Stage IV.

For each 100 pounds of aluminum produced, 12 pounds of $Al_2O$ and 12 pounds of aluminum vapor are produced in Stage VI, 38 pounds of $Al_2O$ and nine pounds of aluminum vapor are produced in Stage V, and 14 pounds of $Al_2O$ are produced in Stage IV. Back reactions recover 48 pounds of $Al_2O$ and 16 pounds of aluminum vapor in Stages II and III. The heat released is used to drive Stage II and Stage III pre-reduction reactions forward, and the net process heat demand of the reactions in the charge column is ±0.35 KWH/lb of product aluminum.

The net energy loss of the 83 pounds of vaporization products thus produced in Stages IV, V, and VI is the amount associated with the fifteen pounds of $Al_2O$ and the four pounds of aluminum vapor leaving Stage II at the top of the charge column. A summary of material and energy balances for each of the eight stages is given in Table I.

The maximum level of $Al_4C_3$ that is allowable in the Stage VI product of open-arc heating, in order to obtain a material balance in the extraction operation of Stage VII, is about 9.5%. If there is more than 9.5% and the extraction operation of Stage VII comes to equilibrium, additional alumina charge to Stage VII will be required and slag exceeding the demand of the primary furnace will be generated in Stage VII. If the open-arc heating product of Stage VI has less than 9.5% $Al_4C_3$, less alumina is added to the extraction operation of Stage VII, meaning that more alumina is added at Stage IV or alumina is added to charge B.

TABLE I

SUMMARY OF MATERIAL AND ENERGY BALANCE

| STAGE | 1 | 2 | 3 | 4 | 5 | 6 | 7 | 8 |
|---|---|---|---|---|---|---|---|---|
| CHARGE: AL203 | .0 | | | .0 | .0 | 9.5 | 179.7 | |
| C | 71.9 | | | | | | | |
| RECYCLE: AL203 | 18.8 | | | | | 179.7 | | |
| AL4C3 | 2.6 | | | | | 10.6 | | |
| AL | 25.0 | | | | | .0 | | |
| INIT SLAG: AL203 | | | | 144.7 | | | | |
| AL4C3 | | | | 20.3 | | | | |
| OUTPUT SLAG: AL203 | .0 | 44.4 | .0 | 96.6 | .1 | 144.7 | 179.7 | |
| C | 62.2 | 56.0 | 19.7 | .0 | | | | |
| AL4C3 | 41.3 | 59.0 | 121.2 | 154.7 | .0 | 20.3 | | |
| OUTPUT METAL: AL4C3 | | | | 6.9 | 51.2 | 13.1 | 2.6 | |
| AL203 | | | | | .0 | 18.8 | 18.8 | |
| AL | | | 14.8 | 14.8 | 110.6 | 125.0 | 125.0 | 100.0 |
| OUTPUT GAS: CO | 167.7 | 167.6 | 163.7 | 115.1 | 64.4 | 16.5 | | |
| AL20 | .0 | 15.2 | 33.0 | 63.0 | 37.7 | 11.6 | | |
| AL | .0 | 4.1 | 5.6 | 20.4 | 8.9 | 11.5 | | |
| N* | | | .000 | .468 | .775 | .910 | .960 | |
| L/S | | 35/65 | 0/100 | 54/46 | | | | |
| TEMPERATURE °C. | 250 | 1970 | 2010 | 2080 | 2100 | 2400 | 1630 | 1000 |
| KWH/LB END PROD | −.506 | −.022 | .345 | .696 | 1.751 | .653 | .663 | −.241 |

PROCESS HEAT DEMAND: 4.108 KWH/LB AL

Initial slag inventory in Stage IV should be kept to the minimum amount to provide the alumina required for Stage V, so that Stage V composite N* remains at or below 0.775 as long as possible.

An important discovery has been made that, by providing for the addition of the process alumina requirement to the decarb furnace or to the primary furnace hearth instead of to charge B, the percent liquid at Stage II, which is high in the column, can be reduced to 35%, compared to about 79% if all the alumina requirements are added with charge B. By keeping charge B as rich in carbon as possible and by encasing the alumina of the dross in pitch coke, the briquettes are less likely to sinter together and cause charge column 28 to slump, so that the charge column remains in vapor-permeable condition and continues to allow the $Al_2O$ vapors to permeate therethrough and back react to equilibrium, thus minimizing energy losses to vaporization.

EXAMPLE 2

Figure 2:
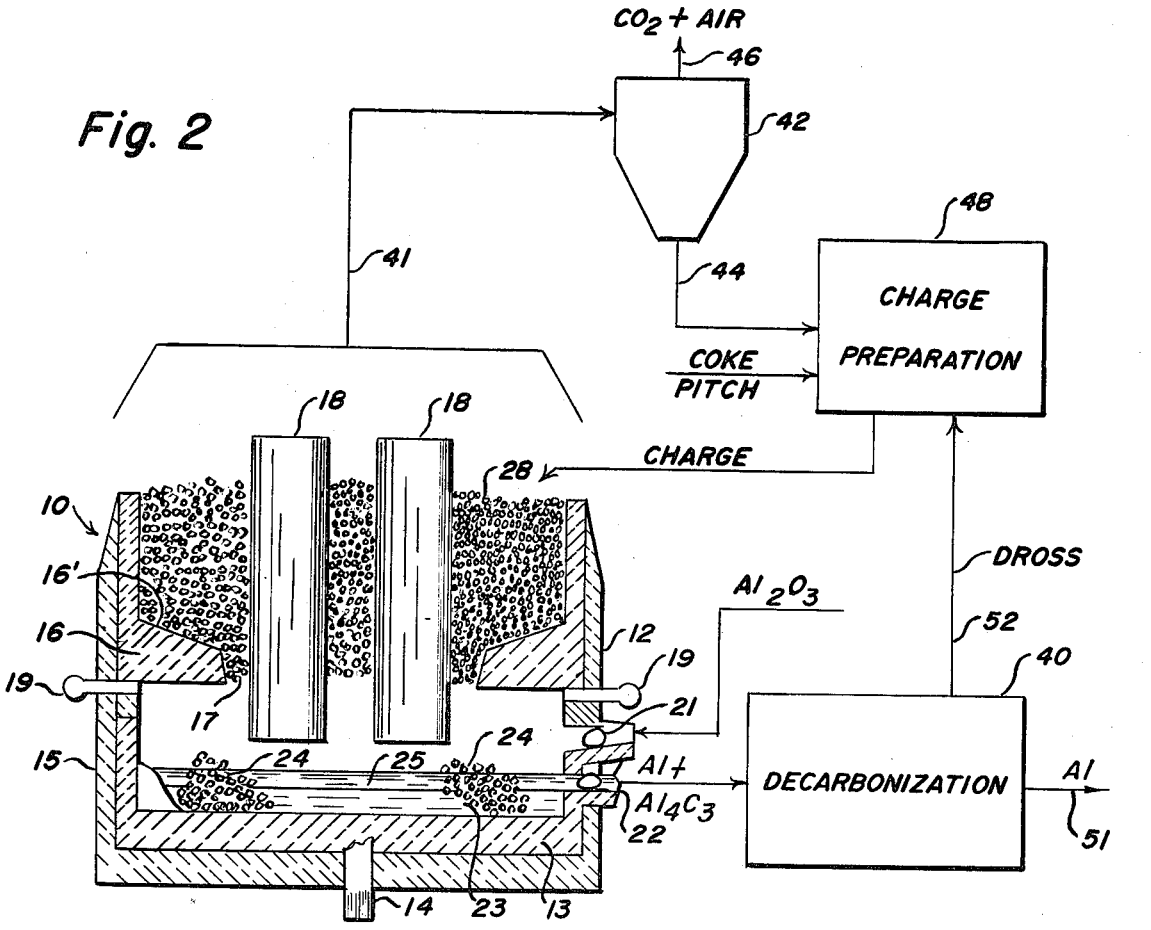
FIG. 2 is a sectional elevation of the same carbothermal reduction furnace shown in FIG. 1. This furnace is connected to a decarbonization furnace as a part of a schematically illustrated closed recycling system.

Utilizing the apparatus shown in FIG. 2, Charges A and B are made up in the form of briquettes as in the countercurrent alumina feed system developed in connection with Example 1, except that only the recycled materials are mixed with pitch to form the briquettes of composition B. All the coke that is required for reduction is charged as green petroleum coke in a size range of two inches down to minus one-fourth inch mesh. All the alumina is charged as metallurgical grade alumina with a particle-size distribution which is typical of the alumina charged to electrolytic reduction cells.

As in the countercurrent alumina feed system, the production cycle starts immediately after tapping by stoking the charge burden above the roof to admit sufficient material to the hearth to provide all of the carbon (either as unreacted coke or as pre-reduction compounds comprising $Al_4O_4C$ and $Al_4C_3$) which is stoichiometrically required to produce the aluminum for the tap at the end of the production cycle. Additional green coke and recycled materials are then added to the top of charge column 28 for restoring its level and for providing reaction zones in which vaporization back reactions can occur during the next production cycle which is to follow.

If some of the slag has been tapped along with the metal of the preceding production cycle, then additional charge must be stoked, over and above the stoichiometric requirement for metal production, in order to restore the carbon content in the slag to a desired starting inventory level.

Sufficient alumina is then added through port 21 in FIG. 2 on a specific schedule during the production cycle to provide the alumina that is stoichiometrically required for the production of the metal to be tapped, less the equivalent alumina content of the charge of pre-reduction product that is stoked plus the alumina required to restore the slag to the inventory desired at the beginning of the cycle.

Electrodes 18 are lowered to come into contact with charge 24, and power is delivered by electrical resistance between the electrodes and hearth 13. As heat is created, any unreacted carbon reacts with the slag to produce $Al_4C_3$ in solution with the slag. After the carbon has thus been converted to $Al_4C_3$, the temperature rises to approximately 2100° C. and metal production begins. As more metal is produced and more alumina is added through port 21, the metal becomes more fluid and it becomes necessary to raise the electrodes to a low-voltage arcing condition to complete the cycle. By the time that all of the alumina for the cycle has been added and all of the power that is needed for reduction during the cycle has been used, the metal will have become decarbonized to the extent that upon freezing it contains from 4 to 10% $Al_4C_3$.

Throughout the production cycle, no additional carbon is admitted to the hearth (except to adjust slag inventory), and the vaporization products back react within the charge column to produce or release heat for the production of $Al_4O_4C$ and $Al_4C_3$. These materials are then available to be stoked and fall upon the hearth during the next succeeding production cycle.

When using this preferred embodiment which does not employ countercurrent alumina feed, no specific method of decarbonizing the primary furnace product, containing from 4 to 10% $Al_4C_3$, must be used in decarbonization furnace 40. However, the decarbonizing method must not be extraction mode slag decarbonization. Any method of decarbonizing to 2% $Al_4C_3$ or less without addition of alumina to decarbonization furnace can be employed. Typically, the primary furnace product may be decarbonized by:

(a) dilution in pure aluminum, followed by gas fluxing;
(b) direct action of chlorine on the primary furnace product; or
(c) simple heating of the primary furnace product to reduction temperature in a container free of reactive carbon, as disclosed in the parent application filed on June 20, 1980.

It has been observed that the primary furnace product made according to this embodiment contains from four to ten percent $Al_4C_3$ and also contains about 12% $Al_2O_3$. The alumina contained in the primary product can react with the $Al_4C_3$ in the product to produce Al, $Al_2O$, and CO. If this is done in the absence of reactive carbon, the metal becomes decarbonized, according to the third decarbonizing method.

EXAMPLE 3

The third preferred process embodiment, utilizing external charging, is illustrated in FIG. 3. This system differs from the systems of the first and second embodiments in that, instead of having a charge column within the furnace, it has one or more plug-flow back-reaction vessels which are disposed outside of the furnace, each containing process reactants as a charge column, through which vapors produced during the reduction and decarbonization stages pass and back react, and from which prereduction products are discharged to the reduction zone by one or more charge admission devices, so that reactive carbon can be depleted from the slag on a planned cyclical basis. Preferably, this system includes two charge columns and requires feeding the entire charge to vessels 81,82.

Furnace 60 is lined with an insulating refractory material 62 and an interior hearth 63 and sides and roof lining 65 of carbon. Hearth 63 is connected to an electrical bus through graphite stubs 64.

Electrically insulating means 69 are provided around each electrode 68 and are adapted to enable carbon monoxide gas to blow downwardly over the electrodes in order to prevent condensation of aluminum around the upper portion of each electrode, thus preventing short circuiting of electrodes 68 to hearth 63. A tapping port 72 is provided. A molten layer of slag 73 rests underneath a molten layer 75 of metal containing aluminum and aluminum carbide. Electrodes 68 are connected in parallel and come into contact with metal layer 75. Heat is generated primarily by passage of electric current through slag layer 73 between electrodes 68 and hearth 63.

Vessel 81 is provided to pre-heat alumina with heat released by the reaction of aluminum and aluminum monoxide vapors with CO which is produced in the reduction furnace within furnace 60. Vessel 82 is provided to pre-heat and partially reduce a charge comprising coke, alumina, and recycled products, similarily using heat released when reduction vaporization products back react. Feeder means 83,84 are provided to control the time and amount that materials are added to furnace 60.

A slag layer 73 is built up by the method described in the first example. The ratio of the flow of reduction vapors and CO through vessels 81 and 82 is controlled by use of valves 85 and 86 to avoid overheating and fusing the alumina in vessel 81.

Charge briquettes, comprising petroluem coke, recycled fume, and dross from the decarbonization operation, are formed. These briquettes are charged to vessel 82 where their component coke undergoes pre-reduction reactions using heat released by back reactions of vapors from reduction furnace 60. Heat is transferred to the briquettes by the CO passing through vessel 82.

To initiate a production cycle, the equivalent mole fraction of the slag is adjusted to N* equals about 0.91 by the addition of alumina from vessel 81 or charge from vessel 82. Then, an amount of charge 76 from vessel 82 that is calculated to be the stoichiometric requirement for the metal to be tapped at the end of the cycle is added to the slag layer 73. An amount of alumina 74 from vessel 81 that is calculated to be the stoichiometric complement of the charge from vessel 82 is also added to the slag at this time.

Power is continued at production level throughout the production cycle. At first the temperature of the slag decreases, and the slag compositions shifts toward N*=0.775 as unreacted carbon in charge 76 reacts with the slag. When the free carbon has been consumed, the temperature rises naturally to reduction temperature and metal production begins. Metal containing approximately 4–10% $Al_4C_3$ is produced until the slag composition has been returned to N*=0.91. This metal is tapped to complete the production cycle.

The method just described produces the lowest liquid/solids ratio in vessel 82. If it is desirable for some reason to have a higher percentage of liquids in vessel 82, some of the alumina required for reduction can be added to the briquettes. Another effect of putting some alumina into the briquettes is that more $Al_4C_3$ will be formed in vessel 82 and less carbon will be reduced directly in the hearth area of this furnace.

Unlike the method of U.S. Pat. No. 4,099,959, this method uses conventional furnaces, does not require slag circulation between two temperature zones, provides means to deplete the slag in reactive carbon at the site of charge addition, and has a much wider range of alumina mole fractions on the hearth during metal production, being about N*=0.39 to N*=0.91.

Adding the three charge materials and operating the furnace according to this embodiment is presented as a summary of material and energy balances in Table II for Example 3.

EXAMPLE 4

Figure 4:
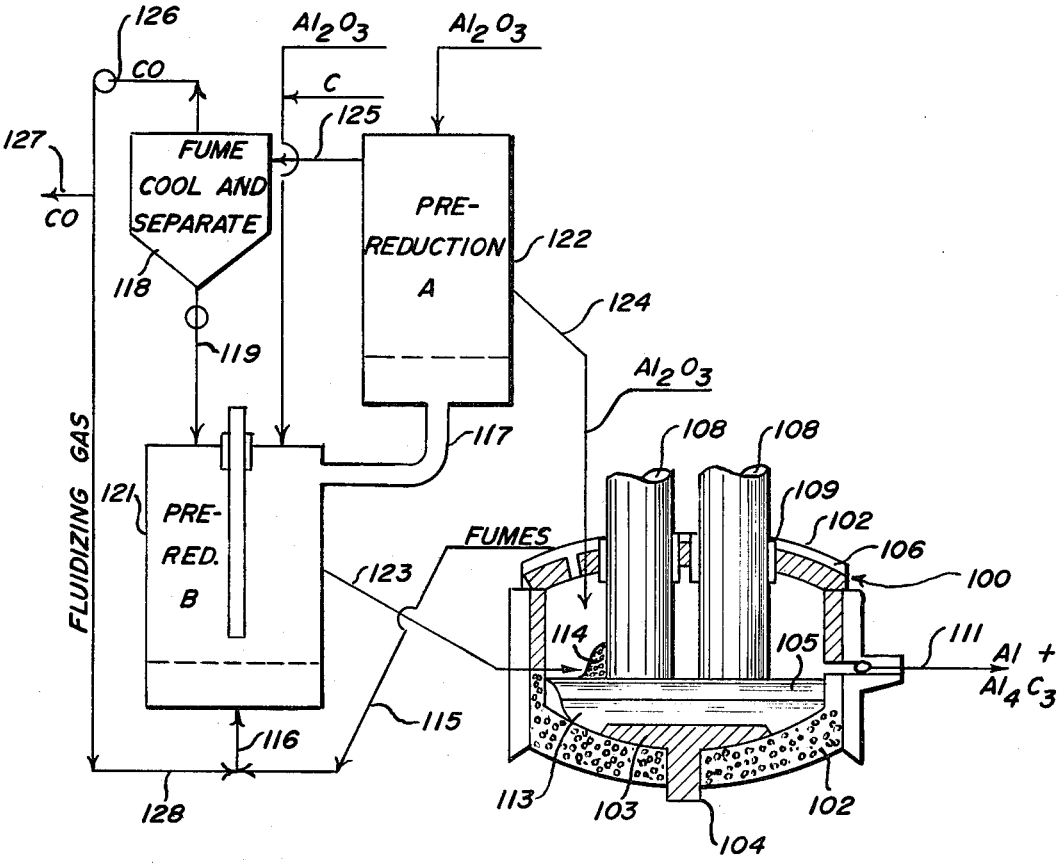
FIG. 4 is a sectional elevation of a carbothermal reduction furnace having its alumina and carbon-based mixtures in two fluidized beds which discharge separately into the furnace but function as scrubbers in series for the furnace vapors.

As seen in FIG. 4, furnace 100 is similarly lined with an insulating refractory material 102 and an interior hearth 103 having sides and a roof lining 106 of carbon. Hearth 103 is connected to an electrical bus through graphite stubs 104. The furnace also has electrically insulating shield means 109 around each electrode 108 for providing an inward flow of carbon monoxide gas over each electrode in order to prevent condensation of aluminum around the upper portion thereof and the consequent electrical short circuiting of electrodes 108 to hearth 103. Furnace 100 has a tapping port and parallel connection of electrodes 108.

Pre-reduction vessel 121 and pre-reduction vessel 122 are connected in series with respect to inflowing gases through lines 115,116,117. Residual gases pass through line 125 into fume separation apparatus 118 and leave as residual gases through lines 126,127, part recirculating through lines 128,116 to vessel 121 and the remaining amount (equal to the amount in line 115) leaving the system through line 127). The total quantity of gas circulating through vessels 121,122 maintains their contents in a fluidized state.

TABLE II

SUMMARY OF MATERIAL AND ENERGY BALANCE

| STAGE | 1 | 2 | 3 | 4 | 5 | 6 | 7 | 8 |
|---|---|---|---|---|---|---|---|---|
| CHARGE: AL203 | .0 | | | .0 | 189.2 | .0 | .0 | |
| 0 | 71.9 | | | | | | | |
| RECYCLE: AL203 | 25.3 | | | | | .0 | | |
| AL4C3 | 18.5 | | | | | .0 | | |
| AL | 66.7 | | | | | .0 | | |
| INIT SLAG AL203 | | | | 87.4 | | | | |
| AL4C3 | | | | 12.6 | | | | |
| OUTPUT SLAG: AL203 | 47.0 | 48.3 | 1.4 | 88.8 | 209.1 | 87.5 | .0 | |
| C | 48.3 | 41.0 | .0 | .0 | | | | |
| AL4C3 | 112.0 | 131.8 | 203.6 | 196.1 | 85.7 | 12.6 | | |
| OUTPUT METAL: AL4C3 | | | | 20.2 | 51.8 | 18.5 | 18.5 | |
| AL203 | | | | | .0 | 25.3 | 25.3 | |
| AL | | | 43.7 | 43.7 | 112.0 | 166.7 | 166.7 | 100.0 |
| OUTPUT GAS: CO | 167.7 | 167.7 | 161.8 | 108.0 | 45.9 | 62.1 | | |
| AL20 | .0 | 15.2 | 32.6 | 70.2 | 26.9 | 43.2 | | |
| AL | .0 | 4.1 | 5.5 | 49.2 | 6.4 | 42.8 | | |
| N* | | | .010 | .390 | .775 | .907 | | |
| L/S | | 27/73 | 1/99 | 44/56 | | | | |
| TEMPERATURE | 250 | 1970 | 2010 | 2000 | 2100 | 2400 | 1630 | 1000 |
| KWH/LB END PROD | −.423 | .025 | −.025 | .092 | 1.974 | 1.855 | −.042 | −.372 |

PROCESS HEAT DEMAND: 3.946 KWH/LB AL

Vessel 122 is charged with alumina, and vessel 121 is charged with carbon, fume that is separated from the gases in line 125 and which enters vessel 121 through line 119 and recycled dross particles. Preheated alumina from vessel 122 then enters furnace 100 through line 124. Preheated and prereduced charge materials from vessel 121 enter furnace 100 through line 123, combining with the alumina from vessel 122 to form charge 114.

Specifically, a primary furnace 100 is initially provided with a molten slag layer 113 as in Examples 1 and 2. Vessel 122 is filled with $Al_2O_3$ and vessel 121 is filled with a mixture of coke, recycled $Al_2O_3$, fume, $Al_4C_3$, and Al, in the form of particles. For each production cycle, producing 100 pounds of Al, a typical charge weighs 182.4 pounds, consisting of 71.9 pounds carbon, 25.3 pounds $Al_2O_3$, and 18.5 pounds $Al_4C_3$ from recycled dross, and 66.7 pounds Al from recycled dross, and is fed to vessel 121. For each production cycle producing 100 pounds of aluminum, a charge control means 123 is operated to admit product from reactor 121, consisting of 1.4 pounds $Al_2O_3$, 203.6 pounds $Al_4C_3$, and 43.7 pounds aluminum, to hearth slag layer 113. Feed means 124 is also operated for vessel 122 unit 189.2 pounds of $Al_2O_3$ are similarly dropped into the hearth to complete charge 114 and as part of mixing stage IV.

With electrodes 108 in contact with slag layer 113, reduction power is started and the furnace 100 passes through Stages IV and V. Reduction proceeds while temperatures stay at about 2000° C. within the hearth until the carbon in the hearth composite has been depleted, producing sufficient $Al_4C_3$ that the N* of the non-metal composite approaches the value of 0.39. Then the temperature rises to about 2100° C. as $Al_2O_3$ and $Al_4C_3$ react within slag layer 113 according to equation R5, producing molten metal that forms overlying metal layer 105 while CO and other gases pass in series into and through the charge columns in vessels 121,122 and thence as residual gases through valves into the fume collection apparatus. CO is the final gas discharged through lines 126,127.

When sufficient $Al_4C_3$ has been consumed according to R5 that N* for layer 113 again approaches 0.91, metal layer 105 contains 4–10% $Al_4C_3$, and this metal layer is then transferred to a finishing operation as described in Example 2 which produces dross to be recycled to apparatus 121 and used in an ensuing cycle, and 100 pounds of output aluminum from the cycle. The operation of the furnace is summarized in Table III as a material and energy balance.

EXAMPLE 5

The fifth preferred apparatus embodiment, having a single charge column that is disposed directly above the hearth, as in the first two embodiments, differs from them in that there is no hearth shoulder to function as a charge admission means. Instead, operating conditions are carefully manipulated so that the charge is selectively self supporting.

Figure 5:
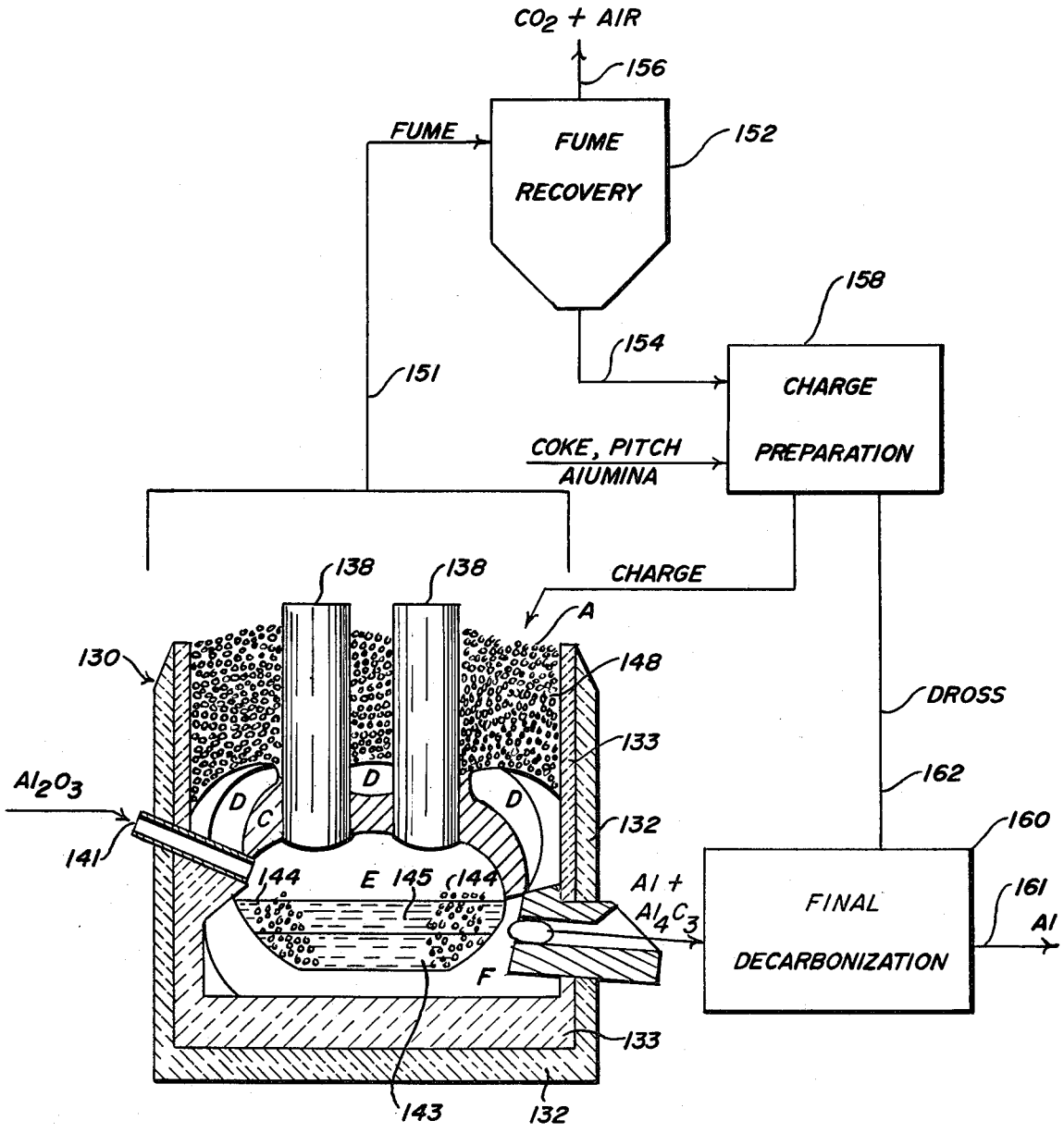
FIG. 5 is a sectional elevation of a moving bed shaft carbothermal reduction furnace, having no hearth shoulder, which is connected to a final decarbonization furnace and is part of a schematically illustrated closed recycling system.

As seen in FIG. 5, primary furnace 130 is a high-voltage, multi-phase AC furnace as is used for the production of silicon. However, it also has means to admit alumina directly to the hearth of the furnace and insulation designed to maintain a temperature of 1980° C. at the interface between the carbon hearth and the lining when a liquid slag is held within the hearth chamber at 2000° C.

TABLE III

SUMMARY OF MATERIAL AND ENERGY BALANCE

| STAGE | 1 | 2 | 3 | 4 | 5 | 6 | 7 | 8 |
|---|---|---|---|---|---|---|---|---|
| CHARGE: AL203 | .0 | | | .0 | 189.2 | .0 | .0 | |
| 0 | 71.9 | | | | | | | |
| RECYCLE: AL203 | 25.3 | | | | | .0 | | |
| AL4C3 | 18.5 | | | | | .0 | | |
| AL | 66.7 | | | | | .0 | | |
| INIT SLAG AL203 | | | | 87.4 | | | | |
| AL4C3 | | | | 12.6 | | | | |
| OUTPUT SLAG: AL203 | 47.0 | 48.3 | 1.4 | 88.8 | 209.1 | 87.5 | .0 | |
| C | 48.3 | 41.0 | .0 | .0 | | | | |
| AL4C3 | 112.9 | 131.8 | 203.6 | 196.1 | 85.7 | 12.6 | | |
| OUTPUT METAL: AL4C3 | | | | 20.2 | 51.8 | 18.5 | 18.5 | |
| AL203 | | | | | .0 | 25.3 | 25.3 | |
| AL | | | 43.7 | 43.7 | 112.0 | 166.7 | 166.7 | 100.0 |
| OUTPUT GAS: CO | 167.7 | 167.7 | 161.8 | 108.0 | 45.9 | 62.1 | | |
| AL20 | .0 | 15.2 | 32.6 | 70.2 | 26.9 | 43.2 | | |
| AL | .0 | 4.1 | 5.5 | 49.2 | 6.4 | 42.8 | | |
| N* | | | .010 | .390 | .775 | .907 | | |
| L/S | | 27/73 | 1/99 | 44/56 | | | | |
| TEMPERATURE | 250 | 1970 | 2010 | 2000 | 2100 | 2400 | 1630 | 1000 |
| KWH/LB END PROD | −.423 | .025 | −.025 | .092 | 1.974 | 1.855 | −.042 | −.372 |

PROCESS HEAT DEMAND: 3.946 KWH/LB AL

Primary furnace 130 is lined with insulation of refractory brick 132 and an inner wall and hearth 133 of carbon. Electrodes 138 are connected in AC 3-phase Y configuration so there is no necessity for current to flow through the hearth. An inner crucible F is formed by freezing alumina from a slag with an alumina content of 90 weight percent $Al_2O_3$ or more, balance being $Al_4C_3$. Within crucible F rests molten slag layer 143. A layer 145 of molten aluminum containing $Al_4C_3$ floats upon slag layer 143.

A mass of semi-reduced compounds D exists around the 1970° C. isotherm. Closer to the source of heat, a mass C, comprising $Al_4C_3$ and $Al_2O_3$ or carbon, is formed at temperatures between 2000° C. and 2050° C.

Means 141 are provided to permit addition of alumina to the hearth without the alumina coming into contact with zones C or D or the unreacted charge in the moving bed shaft A. Tapping port 142 is also provided. Electrical means, comprising a transformer connected at a "neutral" circuit of the electrode power supply, may be connected to tapping port 142 to aid in melting skull F around the tapping port as is required to open the tapping port.

Furnace 160 is of conventional aluminum holding furnace design, being provided with a tapping port, means to discharge fluxing gas out of the top level of the furnace melt, and a skimmer and a port means to remove solid dross from the upper surface of the product aluminum.

A dust collector 152 is provided to receive residual gases leaving furnace 130 through line 151 from furnace 130. This collected fume is sent through line 154 to charge preparation apparatus 158 wherein the recovered fume particles are mixed with petroleum coke, petroleum or coal tar pitch, alumina, and dross skimmed from finishing furnace 160 to prepare briquettes.

Furnace 130 may be started by the procedure described in connection with the first example, whereby a molten slag layer 143 of about 95% $Al_2O_3$, 5% $Al_4C_3$ (melting point around 1980° C.) is developed according to the method described in connection with the first example. This layer is first made to a depth equal to the uppermost expected elevation of the top of layer 145 of metal to be produced. Sufficient slag is then tapped to develop a crucible of frozen slag F and a residual upper level of molten slag 143 at the bottom of the tap hole.

An amount of pre-reduced charge C, containing the amount of carbon, in the form of $Al_4O_4C$, $Al_4C_3$, or C, that is stoichiometrically required for the metal to be tapped, is stoked to fall into slag layer 143, forming reactant charge 144. Additional charge briquettes are added to column 148 to restore its level.

Power is delivered by passage of current between electrodes through zone C and from electrodes to metal or slag and back to adjacent electrodes. As heat is delivered, reaction proceeds between reactants 144 and slag 143 to produce aluminum containing from 30 to 35% $Al_4C_3$. At the same time, some aluminum vapor and aluminum monoxide ($Al_2O$) gas are produced. These, mixed with the CO formed by the aluminum-producing reaction, pass upwardly through zone C and charge column 148, wherein back reactions occur, releasing heat and producing compounds which recycle down with the charge to produce a mixture of $Al_2O_3$, $Al_4C_3$, and $Al_4O_4C$ at around 1970° C. in zone D. At the higher temperatures of zone C, $Al_2O_3$ reacts with more carbon to produce $Al_4C_3$.

This production of $Al_4C_3$ in zone C sets up a sintered roof which prevents further admission of unreacted carbon to the reduction zone during the remainder of the production cycle. As production proceeds, the proportion of alumina, that is stoichiometrically required to produce the aluminum to be tapped but not added with the charge briquettes, is added through charging port 141. As reduction proceeds and more alumina is added, the slag-reactant composition changes from an alumina mole fraction N* of about 0.6 to an alumina mole fraction of about N*=0.92. The metal becomes decarbonized to about 4% $Al_4C_3$ according to the reduction mode of decarbonization disclosed in U.S. Pat. No. 4,216,010.

The power level is then reduced just enough to discontinue production of metal, as evidenced by marked decrease in CO production, and the furnace is held in this condition for about one hour. During this period, a slag temperature of approximately 2000° C. is maintained, alumina freezes out a little to remove reactive carbon from contact with the slag, and the metal is further decarbonized to contain about 2% $Al_4C_3$ according to the extraction mode od decarbonization disclosed in U.S. Pat. No. 4,216,010.

The metal is then tapped to furnace 160 wherein Tri-gas is sparged as the temperature cools to about 900° C., bringing up a dry, fluffy dross comprising about 20% of the aluminum and all of the $Al_2O_3$ and $Al_4C_3$ contained in the tap from furnace 130. The dross is skimmed and returned through line 162 to charge preparation apparatus 158 to be incorporated into primary furnace charge briquettes without significant delay, so that the aluminum carbide has not yet had an opportunity to hydrolyze. Finished aluminum product of commercial purity is then tapped from the finishing furnace.

Immediately after furnace 130 metal has been tapped, the production cycle is repeated, starting with the stoking to admit material from zone C to reduction zone E.

The presently preferred range for percentage of required alumina that is added with the charge briquettes is 20% to 30%. This produces some liquid in zone C to facilitate stoking, but it keeps the percent liquid in zone D down so that the briquettes do not crush and destroy the permeability that is needed for back reactions with vapors and gases.

A summary of a typical stage-by-stage material and energy balance of the process just described is shown in Table IV. The operation system may be described as initially including a charge briquette pre-heat stage which includes the fume recovery unit and recycle therefrom. As charge column A descends the shaft of furnace 130, semi-liquid compounds are produced in zone D and a sinter, primarily $Al_4C_3$, is produced in zone C. Mixing, prereduction, and decarbonization occur sequentially in zone E. Decarbonization then occurs in furnace 160.

It should be understood that the invention is not to be limited to the foregoing embodiments but includes all variations that would occur to one skilled in the aluminum carbothermic production art and as defined by the appended claims.

TABLE IV

SUMMARY OF MATERIAL AND ENERGY BALANCE

| STAGE | 1 | 2 | 3 | 4 | 5 | 6 | 7 | 8 |
|---|---|---|---|---|---|---|---|---|
| CHARGE: AL203 | 47.3 | | | .0 | | 49.5 | 92.3 | |
| 0 | 71.9 | | | | | | | |
| RECYCLE: AL203 | 17.8 | | | 45.2 | | .0 | | |
| AL4C3 | 2.6 | | | 2.7 | | .0 | | |
| AL | 25.0 | | | | | .0 | | |
| INIT SLAG AL203 | | | | 94.4 | | | | |
| AL4C3 | | | | 5.6 | | | | |
| OUTPUT SLAG: AL203 | 86.9 | 72.5 | 21.5 | 161.1 | 84.7 | 47.3 | 139.6 | |
| C | 62.2 | 47.8 | .0 | .0 | | | | |
| AL4C3 | 41.3 | 68.3 | 154.1 | 157.2 | 34.7 | 5.5 | 8.2 | |
| OUTPUT METAL: AL4C3 | | | | 5.1 | 40.2 | 5.2 | 2.6 | |
| AL203 | | | | | .0 | 17.8 | 17.8 | |
| AL | | | 11.1 | 11.1 | 87.0 | 125.0 | 125.0 | 100.0 |
| OUTPUT GAS: CO | 167.7 | 167.7 | 149.9 | 88.4 | 51.8 | 37.5 | | |

TABLE IV-continued

| SUMMARY OF MATERIAL AND ENERGY BALANCE | | | | | | | | |
|---|---|---|---|---|---|---|---|---|
| STAGE | 1 | 2 | 3 | 4 | 5 | 6 | 7 | 8 |
| AL20 | .0 | 15.2 | 30.2 | 78.6 | 29.9 | 48.7 | | |
| AL | .0 | 4.1 | 5.1 | 16.3 | 7.1 | 9.2 | | |
| N* | | | .165 | .591 | .775 | .924 | .960 | |
| L/S | | 48/52 | 16/84 | 71/29 | | | | |
| TEMPERATURE | 250 | 1970 | 2010 | 2080 | 2100 | 2170 | 2000 | 1000 |
| KWH/LB END PROD | −.367 | .311 | .468 | .123 | 1.391 | 1.240 | .462 | −.320 |

PROCESS HEAT DEMAND: 3.996 KWH/LB Al

What is claimed is:

1. A carbothermic process for producing aluminum containing aluminum carbide, comprising the following steps:

A. on a furnace hearth, reacting a mixture comprising solid aluminum carbide and carbon with a liquid slag comprising alumina and aluminum carbide, while providing heat input sufficiently high to produce vapors comprising aluminum metal, aluminum monoxide, and carbon monoxide, and liquid aluminum containing aluminum carbide;

B. decomposing said slag in the absence of reactive carbon or solid aluminum carbide to produce additional aluminum and vapors comprising aluminum metal, aluminum monoxide, and carbon monoxide;

C. passing said vapors produced in steps A and B through at least one zone where said vapors react to produce alumina, aluminum tetraoxycarbide, and aluminum carbide;

D. employing the product of step C as part of said mixture in step A which reacts with said liquid slag on said furnace hearth; and E. recovering product aluminum containing aluminum carbide from step B.

2. The carbothermic process of claim 1, wherein said product aluminum recovered in step E contains from 4 to 12% $Al_4C_3$.

3. The carbothermic process of claim 1, wherein part of the alumina feed that is stoichiometrically required for production of product aluminum is added directly to said furnace hearth in step A and part is added in step C.

4. The carbothermic process of claim 3, wherein the carbon for reduction is added at one or more of the zones of step C in claim 1.

5. The carbothermic process of claim 3, wherein the weight ratio of alumina added in step A to the amount added in step C of claim 1 is varied selectively to provide the desired liquids/solids ratio in step C.

6. The carbothermic process of claim 3, wherein none of the alumina feed is added in step C in order to minimize the liquids/solids ratio in step C.

7. The carbothermic process of claim 1, wherein means are provided to control the admission of reactants to step A so that the slag of steps A and B can be depleted of reactive carbon.

8. The carbothermic process of claim 1, wherein step C is conducted in one or more fluidized bed reactors.

9. The carbothermic process of claim 3, wherein the off-gas from step C is used to preheat the alumina added to step A.

10. A method for producing aluminum as a aluminum furnace product containing not more than 15% $Al_4C_3$ by carbothermic reduction of $Al_2O_3$ while limiting energy lost to vapor production to the equivalent of vaporizing not more than 20% of the aluminum contained in all furnace feed materials, comprising:

A. producing aluminum as an initial aluminum furnace product, which is contaminated with 20–37% $Al_4C_3$ by weight, by reacting alumina, carbon, and recycled materials according to the following steps:

(1) providing a reduction zone containing electrodes, a reduction charge admission means disposed above said reduction zone, and a charging port furnishing access to said reduction zone, (2) forming upon a hearth a molten slag layer containing 80–97% $Al_2O_3$ by weight within said reduction zone, (3) preparing a feed charge mixture comprising said carbon, part or all of said recycled materials, and a part of said alumina, (4) forming at least one back reaction zone which is connected to said reduction zone by said charge admission means, said back reaction zone being in vapor-permeable condition, (5) transferring through said charge admission means, from said back reaction zone to said reduction zone, an amount of said feed charge mixture that contains an amount of carbon which is approximately stoichiometrically equivalent to said initial aluminum furnace product, (6) adding directly to said reduction zone through said charging port a quantity of alumina which, in combination with said part of said alumina admitted to said slag layer through said charge admission means, comprises an amount of alumina which is approximately stoichiometrically equivalent to the aluminum to be contained in said final aluminum furnace product, (7) generating sufficient heat, by passage of electric current between said electrodes and/or from said electrodes to said hearth to said electrodes, to cause said charge mixture and said alumina to react with said slag layer and produce said initial aluminum product as a separate liquid layer over said slag layer, while producing vaporization products which react to said back reaction zone to cause the production of prereduction products;

B. limiting the liquid/solids ratio in said back reaction zone and thereby maintaining said back reaction zone in a non-slumping and vapor-permeable condition by varying amounts of feed carbon and feed alumina that are selectively fed to said at least one back reaction zone and to said reduction zone;

C. finishing said reduction for producing said final furnace product according to the following stages:

(1) operating said charge admission means so that no additional carbon is fed as said charge mixture to said reduction zone, (2) heating said slag layer until reaction temperature rises in said reduction zone and said slag is decomposed to form said final aluminum furnace product as said separate liquid layer; and D. removing said final aluminum furnace product to complete a production cycle.

11. The method of claim 10, wherein said final furnace product is treated in a finishing furnace to produce pure aluminum product and dross skimmed therefrom.

12. The method of claim 11, wherein said method further comprises repeating steps 5 through 7 of Paragraph A and all steps of Paragraphs B–D as an additional production cycle.

13. The method of claim 12, wherein said vaporization products comprise Al, $Al_2O$, and CO.

14. The method of claim 13, wherein reduction to produce aluminum begins with an alumina mole fraction of 0.5–0.6 and continues while said solid $Al_4C_3$ is in contact with slag having an alumina mole fraction of about 0.775.

15. The method of claim 14, wherein said liquid/solids ratio is in the range 35/65 to 52/48 when the temperature in said back reaction zone is about 1970° C.

16. The method of claim 14, wherein said recycled materials comprise furnace fume, collected from said CO, and said dross.

17. The method of claim 10, wherein said at least one back reaction zone is disposed in at least one charge column.

18. The method of claim 10, wherein said electrodes are within a furnace having a bottom as said hearth and wherein said charge admission means comprises hearth shoulders which are disposed above said reduction zone, to form an inner roof therefor, are disposed beneath one said charge column, and are spaced from said electrodes in surrounding relationship thereto.

19. The method of claim 10, wherein each said charge column surrounds a pair of said electrodes and wherein plenum and port means are provided for maintaining an inwardly directed flow of carbon monoxide to prevent condensation of aluminum across the inner wall of said furnace, whereby electrical short circuiting of said electrodes to said furnace bottom is prevented.

20. The method of claim 13, wherein said reduction zone is within a furnace having a roof, said charge admission means is a pair of charging ports through said furnace roof, and said at least one charge column is a pair of charge columns which are outside of said furnace and connected to said pair of charging ports.

21. The method of claim 20, wherein said charge mixture is added to the first charge column and said alumina, mixed with carbon in a weight ratio of 80:20 to 90:10, is added to the second charge column of said pair of charge columns.

22. The method of claim 21, wherein said alumina is formed into briquettes which are coated with said carbon to reduce fusion within said second charge column.

23. The method of claim 20, wherein said back reaction zones exist as fluidized beds within said pair of charge columns, said pre-reduction compounds being added in powder form.

24. The method of claim 23, wherein both said second charge column and said first charge column discharge to said furnace and wherein said vaporization products enter said first charge column and then said second charge column as the fluidizing gases therefor.

25. The method of claim 24, wherein about 30% of said feed alumina and substantially all of said carbon are added to said first charge column and converted to aluminum carbide therein and wherein the remaining feed alumina is preheated in said second charge column and then added to said furnace, whereby said liquid/solids ratio in said first charge column is about 45/55.

26. A batch process for producing aluminum which is contaminated with selected percentages of aluminum carbide, comprising the following steps:

A. providing:
   (1) a charge pre-heating and pre-reduction column, having a top and a bottom, which contains a vapor recapture and back reaction zone that is at increasingly higher temperatures with proximity to said bottom;
   (2) at least one pair of electrodes for creating a reaction zone having a selected heat input thereto, said reaction zone being adjacent to said bottom, and
   (3) a hearth which is adapted to contain liquids and is disposed in proximity to said reaction zone;

B. adding all of the carbon and a portion of the alumina which are stoichiometrically required for producing said aluminum to said top of said column, whereby said carbon and said alumina move downwardly through said zones;

C. adding the remaining portion of said alumina to said hearth;

D. producing a slag layer, comprising liquid alumina and solid alumina carbide, within said hearth;

E. while maintaining said electrodes in contact with said slag layer, reacting said solid aluminum carbide and said liquid alumina to produce a liquid aluminum layer, overlying said slag layer and containing 30–35% aluminum carbide, and vapors comprising aluminum vapor, aluminum monoxide vapor, and carbon monoxide until solid aluminum carbide is no longer present in said slag layer;

F. elevating said electrodes above said liquid aluminum layer to produce open arc heating and to react said aluminum carbide in said aluminum layer with said alumina in said slag layer in the absence of reactive carbon until said aluminum layer contains about 4% aluminum carbide and about 12% alumina while producing vapors comprising aluminum metal, aluminum monoxide, and carbon monoxide;

G. reducing heat input to maintain said slag temperature at about 2000° C. but insufficient to cause production of carbon monoxide and continuing to react said metal layer with said slag layer until said metal layer contains about 2% aluminum carbide;

H. passing said vapors produced in steps E, F, and G through said zones in said charge column, countercurrently to said downwardly moving charge column while transferring sensible heat thereto, and therein back reacting, while releasing heats of reaction to said alumina and said carbon;
   (1) said aluminum vapor with said carbon to form aluminum carbide;
   (2) said aluminum monoxide with said carbon to form alumina and aluminum carbide; and
   (3) said aluminum monoxide with said carbon monoxide to form aluminum tetraoxycarbide and carbon; and I. removing said liquid aluminum layer from said hearth.

27. The batch process of claim 26, wherein said remaining portion of said alumina is selected to control the percent liquid in said vapor recapture and back reaction zone so that said charge column retains permeability to said vapors.

28. The batch process of claim 27, wherein all of the aluminum carbide needed for reduction is produced in said charge column when said remaining portion of said aluminum is less than 67% of said alumina.

29. The batch process of claim 26, wherein said remaining portion is 70–80%, whereby said bottom of said charge column has sufficient strength to form a sintered roof in the vicinity of said reaction zone.

30. The batch process of claim 26, wherein said liquid aluminum layer is purified in a decarbonizing furnace, producing dross as a combination of impurities.

31. The batch process of claim 30, wherein said dross is added to said top of said charge column.

32. The batch process of claim 31, wherein said dross is encased in pitch coke before addition to said charge column.

33. The batch process of claim 26, wherein said carbon monoxide is cleaned is separate fume particulate before being burned in a furnace.

34. The batch process of claim 33, wherein said fume particulate are added to said top of said charge column.

35. A process for the production of aluminum metal which comprises:

A. introducing a charge mixture of alumina and carbon to the top of a downwardly movable and vapor permeable charge column having its bottom disposed:
   (1) above a hearth which is lined with noncarbonaceous materials,
   (2) in surrounding relationship to a pair of electrodes, said carbon being all of that stoichiometrically necessary amount of carbon needed to produce said aluminum metal and said alumina being a portion of the stoichiometrically necessary amount of said alumina needed to produce said aluminum metal;

B. forming a molten slag layer and an overlying layer of molten aluminum metal within said hearth by:
   (1) adding to said hearth:
      (a) an initial amount of said charge mixture from said bottom, and
      (b) an initial amount of alumina through a hearth admission means, whereby the total amount of added alumina corresponds to said stoichiometrically necessary amount of alumina, and the alumina mole fraction of said slag is approximately 0.77 to 0.78,
   (2) operating said pair of electrodes in electrical contact with said slag layer, whereby aluminum carbide, said molten aluminum layer, and vapors comprising aluminum metal, aluminum monoxide, and carbon monoxide are produced;

C. countercurrently passing said vapors through said charge column to form a vapor recapture and back reaction zone therewithin, thereby:
   (1) reacting said vapors with said charge mixture to form alumina, aluminum tetraoxycarbide, and aluminum carbide therewithin while maintaining said charge column in said vapor-permeable condition, and
   (2) heating said charge column by transferring both the sensible heats of said gases and the heat produced by said reacting to said charge mixture;

D. passing residual gases containing fume and carbon monoxide from said top of said charge column and removing said fume therefrom;

E. reducing said aluminum carbide within said molten alumina layer and said molten slag layer until said alumina mole fraction becomes approximately 0.775 and said solid aluminum carbide disappears;

F. operating said electrodes out of contact with said aluminum metal layer until aluminum carbide in solution within said aluminum metal layer is reduced to produce aluminum metal containing about 9.5% aluminum carbide and 12% alumina at an alumina mole fraction of approximately 0.91;

G. removing aluminum metal from said aluminum metal layer;

H. adding a replacement amount of said charge mixture, which includes said fume produced in step D, to said top of said charge column;

I. adding a replacement amount of said alumina to said hearth;

J. operating said pair of electrodes in electrical contact with said slag layer to form molten aluminum, while repeating steps C through E; and K. cyclically repeating steps F through J.

36. In a carbothermic process for the reduction of alumina in order to produce aluminum containing aluminum carbide within a reduction furnace having a reduction zone containing electrodes, a reduction charge admission means disposed above said reduction zone, and a charging port furnishing access to said reduction zone, the improvement for producing aluminum as an aluminum furnace product containing not more than 15% $Al_4C_3$ by carbothermic reduction of $Al_2O_3$ while limiting energy lost to vapor production to the equivalent of vaporizing not more than 20% of the aluminum contained in all furnace feed materials, comprising the following steps:

A. forming a molten slag layer containing 80–97% $Al_2O_3$ by weight within said reduction zone;

B. preparing a feed charge mixture, comprising carbon, recycled materials, and a part of said alumina, and adding said feed charge mixture above said reduction charge admission means;

C. forming back reaction zone within said added feed charge mixture, said back reaction zone being in vapor-permeable condition;

D. transferring to said reduction zone from said back reaction zone an amount of back-reacted feed charge mixture that contains an amount of carbon which is approximately stoichiometrically equivalent to the carbon to be contained in said aluminum furnace product;

E. adding directly to said reduction zone through said charging port a substantial portion of said alumina to be reacted which, in combination with said part of said alumina admitted to said slag layer through said charge admission means, comprises an amount of alumina which is approximately stoichiometrically equivalent to the aluminum to be contained in said aluminum furnace product; and F. generating sufficient heat, by passage of electric current through said electrodes, to cause said charge mixture and said alumina to react with said slag layer and produce said aluminum product as a separate liquid layer over said slag layer, while producing vaporization products which react in said back reaction zone to cause the production of prereduction products in said back-reacted feed charge mixture.

37. A process for the production of aluminum metal which comprises:

A. introducing a charge mixture of alumina and carbon to the top of a downwardly movable and vapor-permeable charge column having its bottom disposed:

(1) above a hearth which is lined with non-carbonaceous materials, (2) in surrounding relationship to at least a pair of electrodes, said carbon in said charge mixture being all of that stoichiometrically necessary amount of carbon needed to produce said aluminum metal and said alumina in said charge mixture being a portion of the stoichiometrically necessary amount of said alumina needed to produce said aluminum metal;

B. forming a molten slag layer and an overlying layer of molten aluminum metal within said hearth by:

(1) adding to said hearth:

(a) an initial amount of said charge mixture from said bottom, and (b) an initial amount of alumina through a hearth admission means, whereby the total amount of added alumina from said bottom and through said hearth admission means corresponds to said stoichiometrically necessary amount of alumina, (2) operating said pair of electrodes in electrical contact with said slag layer, whereby aluminum carbide, said molten aluminum layer, and vapors comprising aluminum metal, aluminum monoxide, and carbon monoxide are produced;

C. reducing said aluminum carbide within said molten slag layer until said solid aluminum carbide disappears and vapors comprising aluminum metal, aluminum monoxide, and carbon monoxide are produced;

D. operating said electrodes out of contact with said aluminum metal layer until aluminum carbide in solution within said aluminum metal layer is reduced to produce aluminum metal containing about 4 to 12% aluminum carbide and about 12% alumina and to produce vapors comprising aluminum metal, aluminum monoxide, and carbon monoxide;

E. countercurrently passing said vapors from steps B, C, and D through said charge column to form a vapor recapture and back reaction zone therewithin, thereby:

(1) reacting said vapors with said charge mixture to form alumina, aluminum tetraoxycarbide, and aluminum carbide therewithin while maintaining said charge column in said vapor-permeable condition, and (2) heating said charge column by transferring to said charge mixture both the sensible heats of said vapors from steps B, C, and D and the heat produced by said reacting in sub-step E-1;

F. passing residual gases containing fume and carbon monoxide from said top of said charge column and removing said fume therefrom;

G. removing aluminum metal from said aluminum metal layer;

H. adding a replacement amount of said charge mixture, which includes said fume produced in step F, to said top of said charge column;

I. adding a replacement amount of said alumina to said hearth; and

J. cyclically repeating steps B through I.

38. The method of claim 37, wherein a first pre-reduction stage occurs high in said charge column as a part of said vapor recapture and back reaction zone formed in said step E and wherein said reacting proceeds according to the following three equations:

$$2Al_2O_3(S)+3C \rightleftarrows Al_4O_4C(S)+2CO$$

$$AL_4O_4C(S)+C \rightleftarrows 2Al_2O+2CO$$

$$4Al(g)+3C \rightleftarrows Al_4C_3(S)$$

39. The method of claim 38, wherein said charge column is maintained in vapor-permeable condition by feeding only said portion of said charge mixture to said charge column and by feeding said replacement amount of said alumina to said hearth.

40. The method of claim 39, wherein the percent liquid at said first pre-reduction stage can be reduced from about 79%, which occurs if all of said stoichiometrically necessary amount of said alumina of step A is added to said top of said charge column, to about 35% by adding said initial amount of said alumina and said replacement amount of said alumina to said hearth according to steps B and I.

* * * * *